US009718589B2

(12) United States Patent
Kopulos et al.

(10) Patent No.: US 9,718,589 B2
(45) Date of Patent: Aug. 1, 2017

(54) CONTAINER SYSTEMS WITH LIDS FOR UNIT DOSE DETERGENT COMPOSITIONS

(75) Inventors: Christopher Robert Kopulos, Cincinnati, OH (US); Brian David Andres, Harrison, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 608 days.

(21) Appl. No.: 13/017,245

(22) Filed: Jan. 31, 2011

(65) Prior Publication Data

US 2011/0204087 A1 Aug. 25, 2011

Related U.S. Application Data

(60) Provisional application No. 61/299,635, filed on Jan. 29, 2010.

(51) Int. Cl.

| | |
|---|---|
| ***B65D 90/02*** | (2006.01) |
| ***B65D 43/02*** | (2006.01) |
| ***B65D 21/02*** | (2006.01) |
| ***B65D 43/16*** | (2006.01) |
| ***D06F 39/02*** | (2006.01) |

(52) U.S. Cl.

CPC ..... *B65D 43/0202* (2013.01); *B65D 21/0219* (2013.01); *B65D 43/169* (2013.01); *D06F 39/024* (2013.01); *B65D 2543/00027* (2013.01); *B65D 2543/00083* (2013.01); *B65D 2543/00296* (2013.01); *B65D 2543/00564* (2013.01); *B65D 2543/00842* (2013.01)

(58) Field of Classification Search

USPC ..... 220/254.1, 810, 378; 215/384

See application file for complete search history.

(56) References Cited

U.S. PATENT DOCUMENTS

| | | | |
|---|---|---|---|
| D49,292 | S | 5/1916 | West |
| D73,643 | S | 10/1927 | Crimmel |

(Continued)

FOREIGN PATENT DOCUMENTS

| | | |
|---|---|---|
| EC | 000128673-0001 | 1/2004 |
| EC | 001688128 | 3/2010 |

(Continued)

OTHER PUBLICATIONS

International Search Report 6 Pages.

*Primary Examiner* — Jeffrey Allen
*Assistant Examiner* — Kevin Castillo
(74) *Attorney, Agent, or Firm* — Gregory S. Darley-Emerson; Leonard W. Lewis; Steven W. Miller

(57) ABSTRACT

A container system includes a tub including a front wall, a back wall opposite the front wall and side walls extending between the front wall and the back wall. A bottom extends between the front wall, back wall and side walls. A mouth structure includes a fastening feature configured for connecting to a lid. The mouth structure has an opening therethrough that provides access to a containing volume of the tub. A shoulder extends inwardly from the side walls to the mouth structure. A plurality of unitized doses of a detergent composition is located within the containing volume of the tub. A lid is connected to tub using the fastening feature. The lid has an open position for allowing user access to the containing volume and a closed position for preventing user access to the containing volume.

29 Claims, 19 Drawing Sheets

(56) References Cited

U.S. PATENT DOCUMENTS

| | | | | | |
|---|---|---|---|---|---|
| 4,133,445 | A | * | 1/1979 | Mandelbaum | 220/23.4 |
| 5,137,260 | A | * | 8/1992 | Pehr | 215/216 |
| 5,353,946 | A | * | 10/1994 | Behrend | 220/326 |
| D370,850 | S | * | 6/1996 | Beaver | D9/543 |
| 5,582,314 | A | * | 12/1996 | Quinn et al. | 220/326 |
| 5,954,241 | A | * | 9/1999 | Huang | 222/548 |
| D576,883 | S | | 9/2008 | Carapelli | |
| D581,288 | S | | 11/2008 | Villalobos | |
| D584,154 | S | | 1/2009 | Fitzsimmons et al. | |
| D637,912 | S | | 5/2011 | Van Den Wouwer et al. | |
| D656,402 | S | | 3/2012 | Kopulos et al. | |
| 2007/0111918 | A1 | * | 5/2007 | Caswell et al. | 510/439 |
| 2007/0114142 | A1 | * | 5/2007 | Sine et al. | 206/210 |
| 2008/0000872 | A1 | | 1/2008 | Amemiya | |
| 2008/0156858 | A1 | * | 7/2008 | Perry et al. | 229/104 |
| 2010/0045111 | A1 | | 2/2010 | Abramovich et al. | |
| 2011/0127271 | A1 | | 6/2011 | Jawarski et al. | |

FOREIGN PATENT DOCUMENTS

| | | | |
|---|---|---|---|
| EP | 0 125 501 | A1 | 11/1984 |
| EP | 0 957 133 | A1 | 11/1999 |
| EP | 0957033 | A1 | 11/1999 |
| EP | 2258820 | A1 | 12/2010 |
| EP | 002231753 | | 3/2013 |
| WO | WO 2005/118421 | A1 | 12/2005 |

* cited by examiner

CONTAINER SYSTEMS WITH LIDS FOR UNIT DOSE DETERGENT COMPOSITIONS

CROSS-REFERENCE TO RELATED APPLICATIONS

This application claims priority under 35 U.S.C. §119(e) to U.S. Provisional Application No. 61/299,635, filed Jan. 29, 2010.

FIELD OF THE INVENTION

One or more embodiments shown and described herein are generally directed to container systems and their lids for unit dose detergent compositions.

BACKGROUND

Detergent compositions, such as laundry detergent, may often be found in various powder forms, which are typically contained in a box-like container. Such containers may be perforated to allow formation of an openable lid to gain access to the detergent, or such containers may have a dispensing closure, such as a "push-pull" type of dispensing closure that can be selectably opened to allow a consumer to dispense the detergent from the container.

Accordingly, improved detergent container systems are continually desirable.

SUMMARY

In certain embodiments detergent compositions in "unit dose" form may be provided. For example, detergent compositions may be provided in a single dose of compacted powdered detergent contained within a sealed, flexible membrane to form such "unit dose". During a wash cycle, the unit dose may be placed in water, wherein it disperses within the water of the wash cycle. Such unit dose detergent compositions may generally be sold in box-like plastic containers and a user may typically extract a unit dose for use by removing the lid of the container and then removing the desired unit dose through an opening of the container. Because unit dose compositions and the flexible outer membrane may be formulated to dissolve or otherwise break down in water, the lids of the container may inhibit entrance of water into the container. However, in order to inhibit the entrance of water into the container, the lids may typically have a resistance to their removal such that it takes both hands to remove the lid, i.e., one hand on the container and one hand removing the lid. It has been surprisingly discovered that certain packages as shown and described herein enable a container for unit doses of a detergent composition that is easy to handle, versatile and/or provides sufficient sealing function against moisture.

In one embodiment, a container system includes a tub including a front wall, a back wall opposite the front wall and side walls extending between the front wall and the back wall. A bottom extends between the front wall, back wall and side walls. A mouth structure includes a fastening feature configured for connecting to a lid. The mouth structure has an opening therethrough that provides access to a containing volume of the tub. A shoulder extends inwardly from the side walls to the mouth structure. A plurality of unitized doses of a detergent composition is located within the containing volume of the tub. A lid is connected to tub using the fastening feature. The lid has an open position for allowing user access to the containing volume and a closed position for preventing user access to the containing volume.

BRIEF DESCRIPTION OF THE DRAWINGS

The following detailed description of specific embodiments of the present invention can be best understood when read in conjunction with the drawings enclosed herewith.

Figure 1:
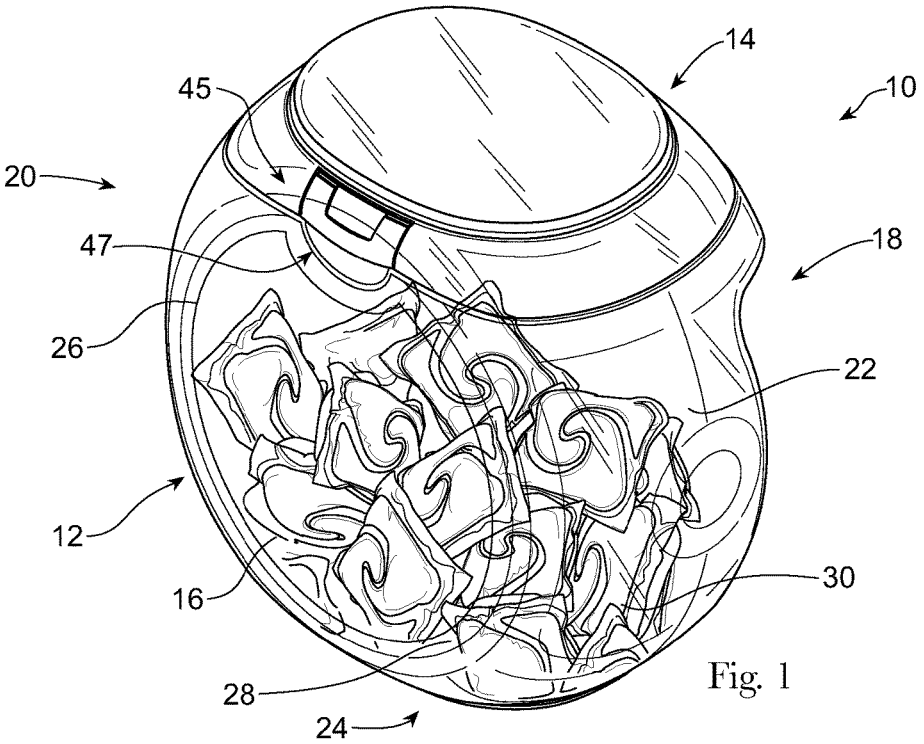
FIG. 1 is a perspective front view of an embodiment of a container system for containing unit doses.

The embodiments set forth in the drawings are illustrative in nature and not intended to be limiting of the invention defined by the claims. Moreover, individual features of the drawings and invention will be more fully apparent and understood in view of the detailed description.

DETAILED DESCRIPTION

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Embodiments described herein generally relate to container systems for holding a number of unitized doses of a detergent composition, such as a laundry detergent composition. As used herein, the term 'detergent composition' is hereby defined to mean any of the agents conventionally used for removing soil, such as general household detergents or laundry detergents of the synthetic or soap type. The term may also include other cleaning agents. The container systems may include a number of features providing, among others, ease of handling, versatility and/or sealing functions to protect the unitized doses from exposure to water while in the container system. As used herein, the terms 'unitized dose' and 'unit dose' are hereby defined to mean a dose of detergent product incorporating one or more laundry detergent compositions sufficient for a single wash cycle. Suitable unit dose forms include capsules, sachets and pouches any of which can have single or multiple compartments. Suitable unit dose forms for use herein include water-soluble, water-dispersible and water-permeable capsules, sachets and pouches. Suitable water soluble pouches may be based on partially hydrolysed polyvinyl alcohol as pouch material. An example of a water-soluble substrate is discussed in, for example, U.S. Ser. No. 11/824,703, entitled "Water-Soluble Substrate with Resistance to Dissolution Prior to Being Immersed in Water," filed Jul. 2, 2007. Detergent compositions can be in liquid, gel, powder and/or paste form, which is herein incorporated by reference in its entirety.

Referring to FIGS. 1-4, an embodiment of a container system 10 is shown. The container system 10 generally includes a tub 12 and a lid 14. The tub 12 may include a front wall 16, a rear wall 18 opposite the front wall 16 and side walls 20 and 22 extending between the front wall 16 and the rear wall 18. A bottom 24 may provide a base structure for the container system 10 that extends between the front wall 16, rear wall 18 and side walls 20 and 22. The bottom 24 may provide the base structure for supporting the container system 10 in an upright, standing position, as illustrated by FIG. 1, when resting on a support surface. While the bottom 24 is illustrated as being arcuate (e.g., concave curvature), it may be flat.

As can be seen by FIG. 1, a label 26 may be located at a front face 28 of the front wall 16. The label 26 may be formed of any one or more suitable materials, such as paper, plastic film, combinations thereof, etc. The label 26 may be adhered (e.g., using a pressure sensitive adhesive), shrink fit or otherwise attached to the tub 12 by any suitable manner. The label 26 may have an identifier (e.g., printed thereon) that identifies a source of the container system 10. In some embodiments, the label 26 may have a dimension (e.g., width and/or height) that is less than a dimension (e.g., width and/or height) of the front face 28. In embodiments where the tub 12 is formed of a transparent or semi-transparent material, such a smaller dimensioned label 26 can facilitate viewing of unitized doses 30 of detergent compositions through the front wall 16 of the container system 10 (e.g., along areas adjacent the periphery of the label 26). Such viewing capability may be desirable, for example, so that consumers can see contents of the container systems 10 when placed on a shelf for consumer purchase. In other embodiments, the tub 12 or one or more portions thereof may be formed of an opaque material, such that the contents of the container system 10 may not be seen through the tub 12. In still other embodiments, a portion or all of the front wall 16 may be transparent and/or semi-transparent and the label 26 may be configured to include one or more windows and/or openings (not shown) therein (i.e., portions where there is not label material) in order to facilitate viewing of the unitized doses 30 of detergent compositions through both the label and the front wall 16. In addition, the one or more windows may comprise a transparent and/or semi-transparent material.

Figure 2:
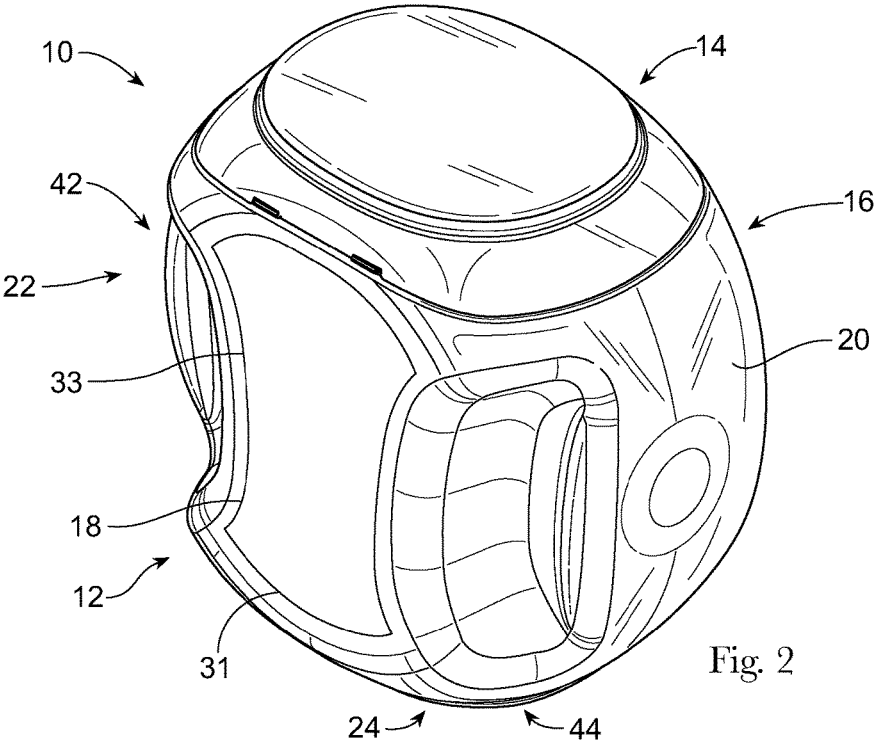
FIG. 2 is a perspective rear view of the container system of FIG. 1.
Figure 3:
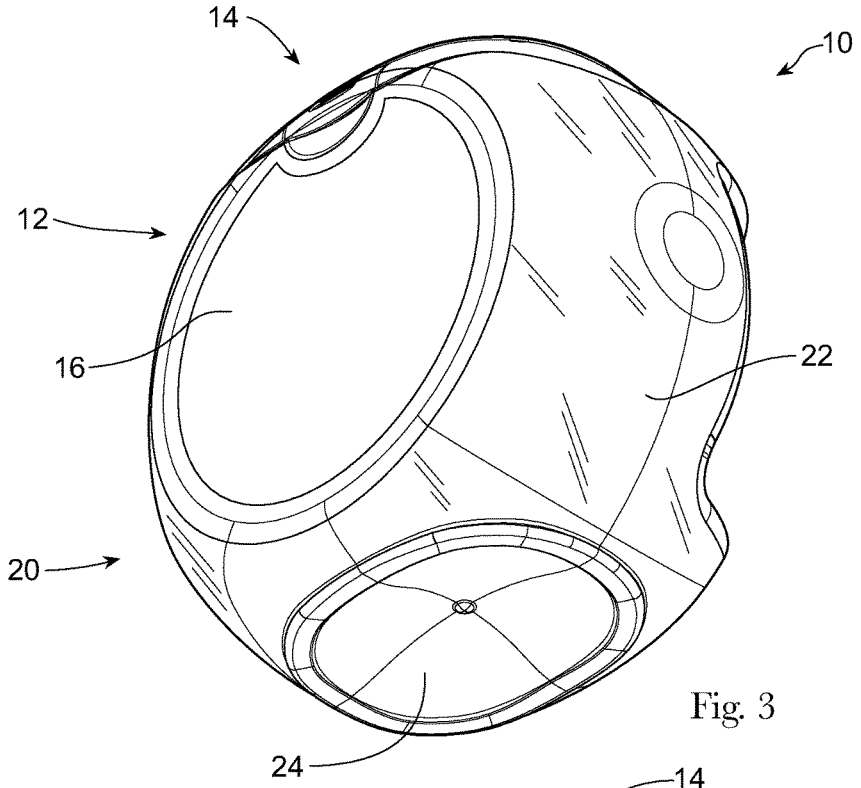
FIG. 3 is another perspective front view of the container system of FIG. 1.
Figure 4:
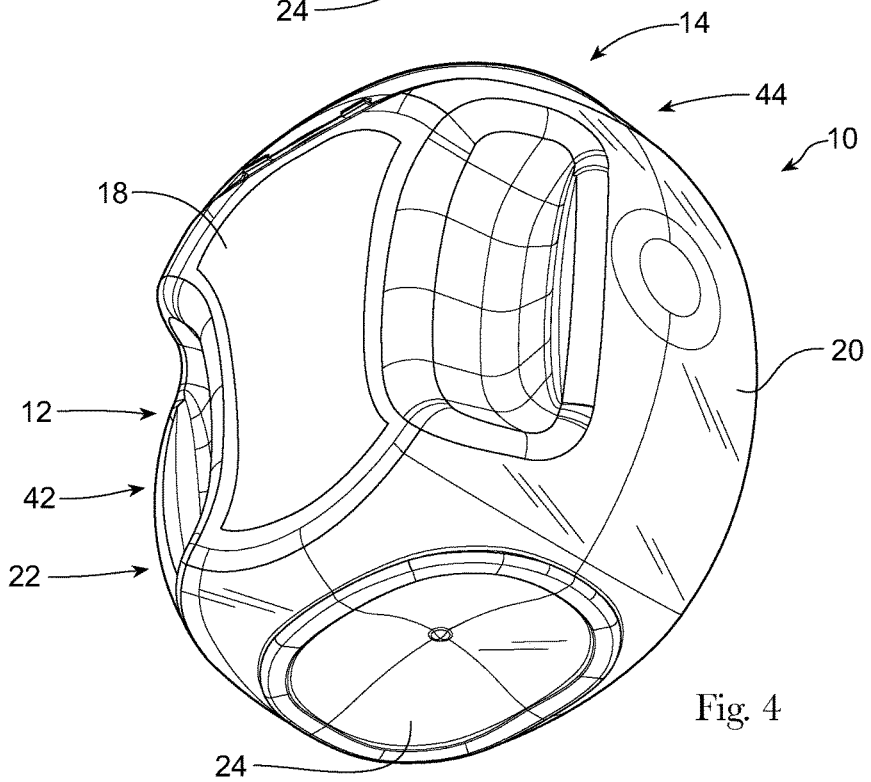
FIG. 4 is another perspective rear view of the container system of FIG. 1.
Figure 5:
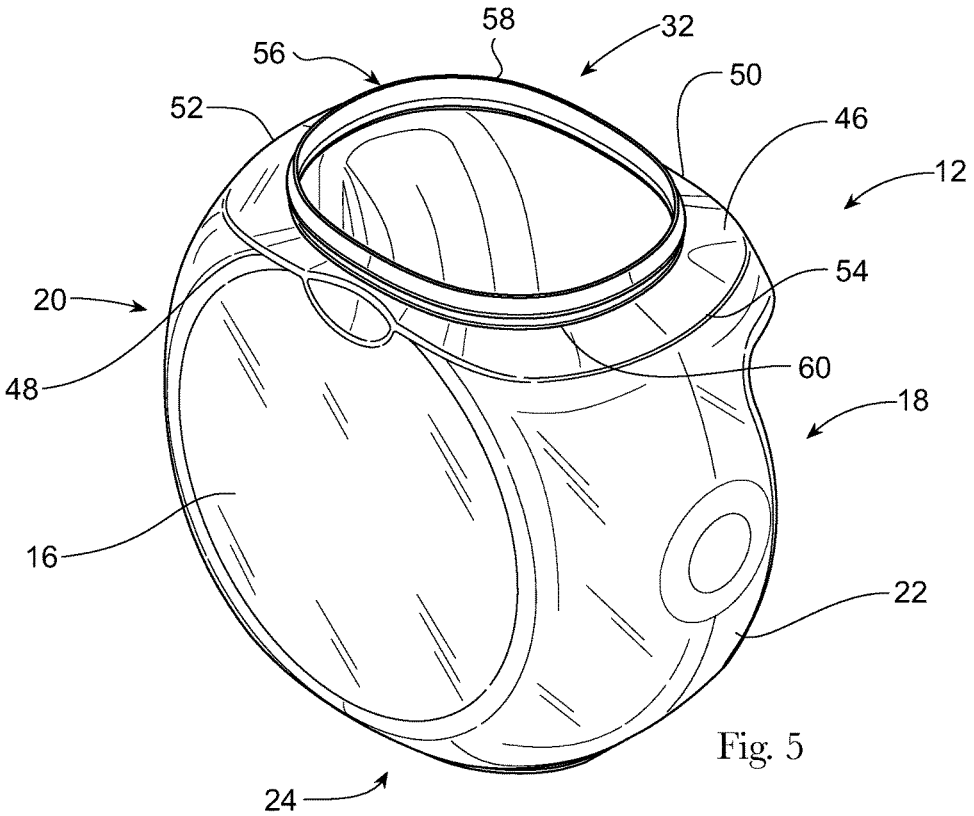
FIG. 5 is a perspective front view of an embodiment of a tub for use with the container system of FIG. 1.
Figure 6:
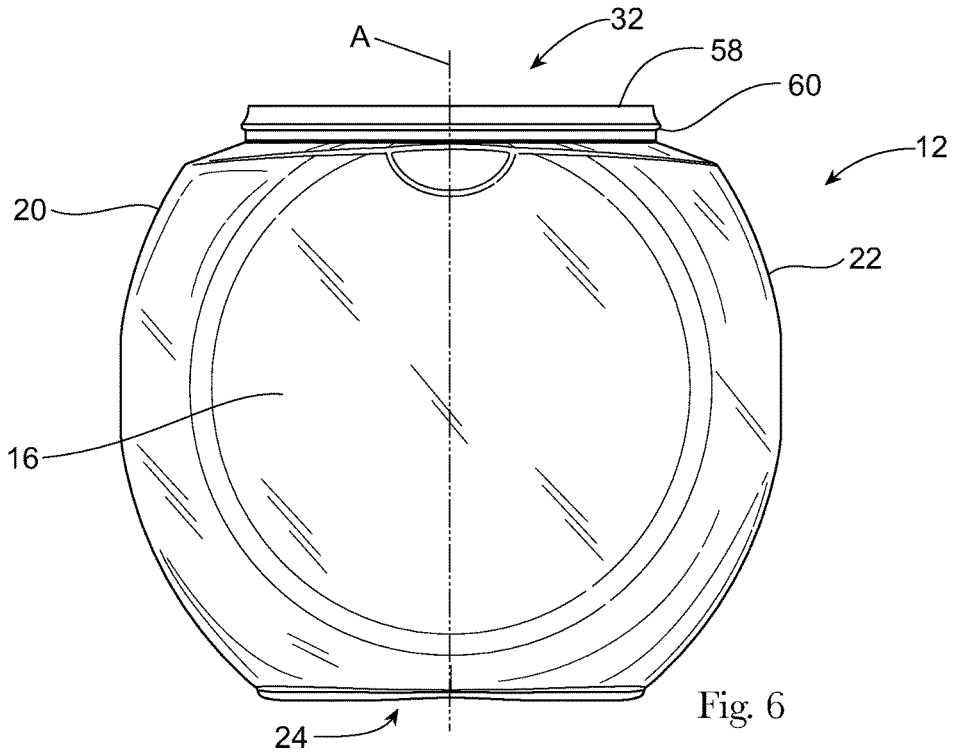
FIG. 6 is a front view of the tub of FIG. 5.

Referring to FIG. 2, a label 31 may also be located at a rear face 33 of the rear wall 18. The label 31 may be located between handle structures 42 and 44, which will be described in greater detail below. In the embodiment of FIG. 2, the label 31 may comprise a shape that approximates an hourglass shape or be substantially hourglass shaped to fit between the handle structures 42 and 44, however, other shapes and sizes are possible.

Referring back to FIG. 1, the container system 10 may include a latching system 45 that can be used to secure the lid 14 in the illustrated closed position. The tub 12 may include a feature, such as a recess 47 that can facilitate latching and unlatching of the latching system 45 in order to open and close the lid 14. Additionally, the provision of the latching system 45 facilitates the opening of the container system 10 with one hand, thus facilitating access to the enclosed articles by both left-handed and right-handed users, as well as by a user whose one hand is occupied in a task, such as holding a child, and who therefore must use his or her free hand, which may be left or right, to reach for the enclosed articles. Additional details of the latching system 45 will be described in greater detail below.

Referring now to FIGS. 5-8, the tub 12 is illustrated in isolation with the lid 14 removed. As shown, the tub 12 may have a somewhat rounded configuration with the front wall 16 and rear wall 18 being flat or planar. In some embodiments, although flat, one or both the front wall 16 and the rear wall 18 may be slanted at an angle relative to the vertical (e.g., five degrees or less), which can reduce contact between adjacent tubs 12 and reduce scuffing or otherwise rubbing contact against any labels affixed to the respective wall. The side walls 20 and 22 (or at least portions thereof) may be rounded. In the illustrated embodiment, the side walls 20 and 22 curve outwardly from a lid-receiving portion 32 of the tub 12 and then curve inwardly to the bottom 24 (e.g., convex or substantially convex curvature). In some embodiments, the radius of curvature of both side walls 20 and 22 may be about the same along the lengths of the side walls 20 and 22 or the radius of curvature of the side walls 20 and 22 may be different. In embodiments where the curvatures are the same, the tub 12 may be symmetric about a vertical axis A extending through a center of the tub 12.

Figure 7:
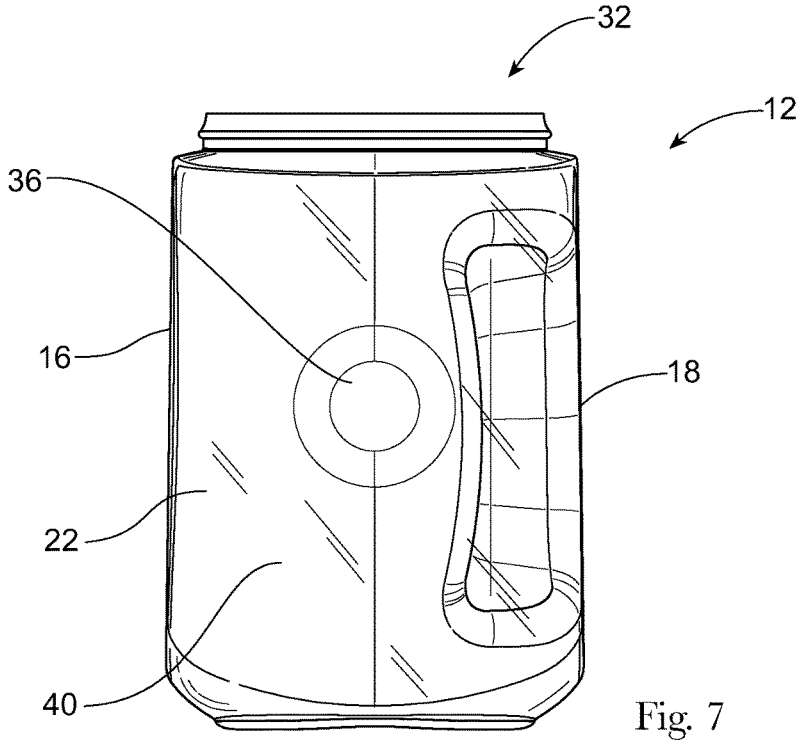
FIG. 7 is a side elevational view of the tub of FIG. 5.
Figure 8:
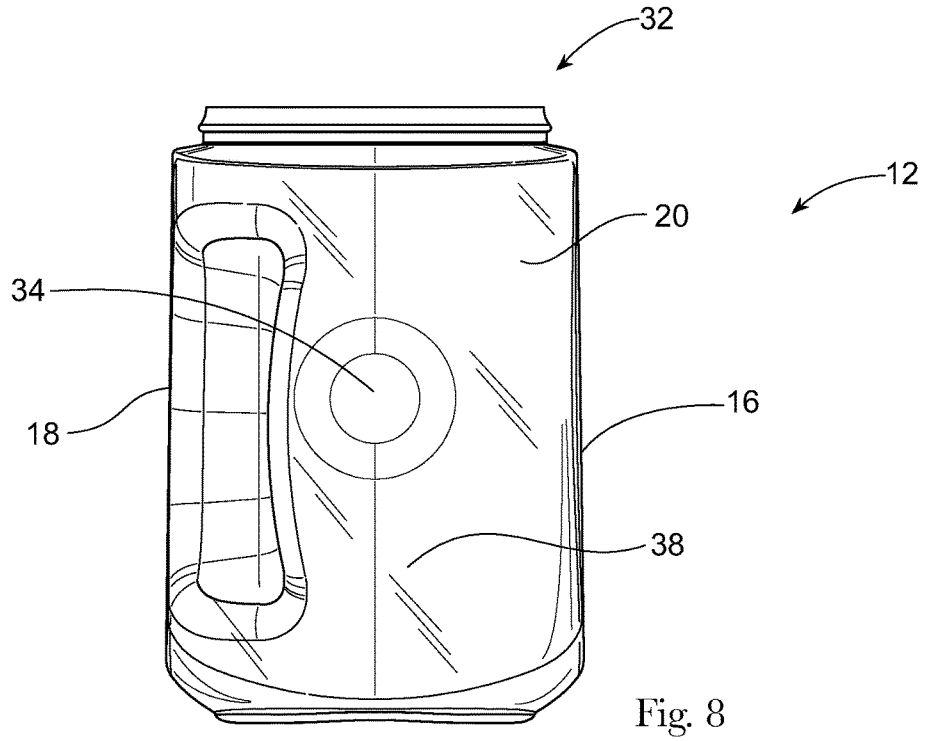
FIG. 8 is a side elevational view of the tub of FIG. 5.

Referring particularly to FIGS. 7 and 8, one or both of the side walls 20 and 22 may include a flat portion 34 and 36 that is bounded by curved portions 38 and 40. The flat portions 34 and 36 are illustrated as being somewhat circular and oriented vertically, substantially parallel with axis A; however other shapes and orientations may be used such as various polygonal shapes. The curved portions 38 and 40, as noted above, curve from the lid receiving portion 32 to the bottom 24 and may also curve from the front wall 16 to the rear wall 18 (see FIG. 9). In other words, each of the side walls 20 and 22 may curve bi-directionally (e.g., bi-directional radii of curvature) and include an island or discrete flat portions 34 and 36. As will be described in greater detail below, the flat portions 34 and 36 may provide contact regions where filled container systems 10 may come into side-by-side contact, for example, during a conveying process. In some embodiments, the flat portions 34 and 36 may be located at about a position along the side walls 20 and/or 22, respectively, that is horizontally aligned with the center of gravity of the container system 10. In other embodiments, the flat portions 36 and/or 36 may be located at and/or above a position along the side walls 20 and/or 22, respectively, that is horizontally aligned with the center of gravity of the container system 10.

Referring to FIGS. 5, 6, 9 and 10, the lid receiving portion 32 includes a shoulder 46 that extends inwardly from upper edges 48, 50, 52 and 54 of the front wall 16, rear wall 18 and side walls 20 and 22, respectively, to a mouth structure 56. The mouth structure 56 extends upwardly from the shoulder 46, terminating at an upper mouth edge 58. A fastening feature in the form of a rib 60 extends about a periphery of the mouth structure 56 as shown, for example, in FIGS. 6 and 9. In some embodiments, the rib 60 is a single, continuous rib that extends about the entire periphery of the mouth structure 56. Other configurations are possible, however, such as, for example, multiple or discontinuous rib structures.

Figure 9:
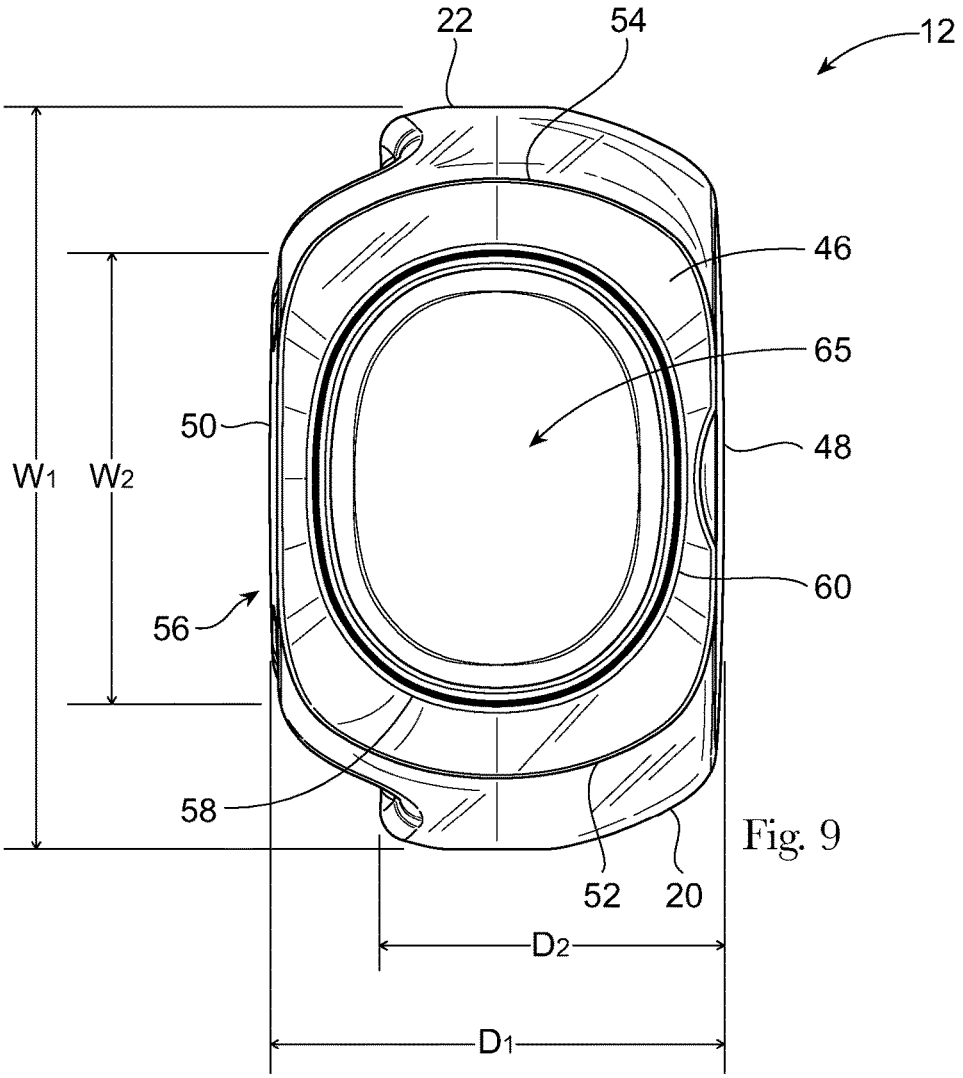
FIG. 9 is a top view of the tub of FIG. 5.

Referring to FIG. 9, the tub 12 may be formed having a maximum width $W_1$ measured between the side walls 20 ad 22 that is greater than a maximum width $W_2$ of an opening 65 formed by the mouth structure 56. The tub 12 may also be formed having a maximum depth $D_1$ measured between the front wall 16 and the rear wall 18 that is greater than a maximum depth $D_2$ of the opening 65 formed by the mouth structure 56 as shown in FIG. 9. Providing such a smaller dimensioned opening 65 can reduce unintended dispensing of contents (e.g., unit doses 30) in the tub 12 by providing the shoulder 46, which can act as a barrier against tub contents from reaching and/or exiting the opening 65 particularly when the tub 12 is laying on its front or rear wall 16 or 18. In some embodiments, $W_2$ may be about 90 percent or less of $W_1$, such as about 80 percent or less of $W_1$, such as about 70 percent or less of $W_1$, such as about 60 percent or less of $W_1$, such as about 50 percent or less of $W_1$. In some embodiments, $L_2$ may be about 90 percent or less of $L_1$, such as about 80 percent or less of $L_1$, such as about 70 percent or less of $L_1$, such as about 60 percent or less of $L_1$, such as about 50 percent or less of $L_1$.

Figure 10:
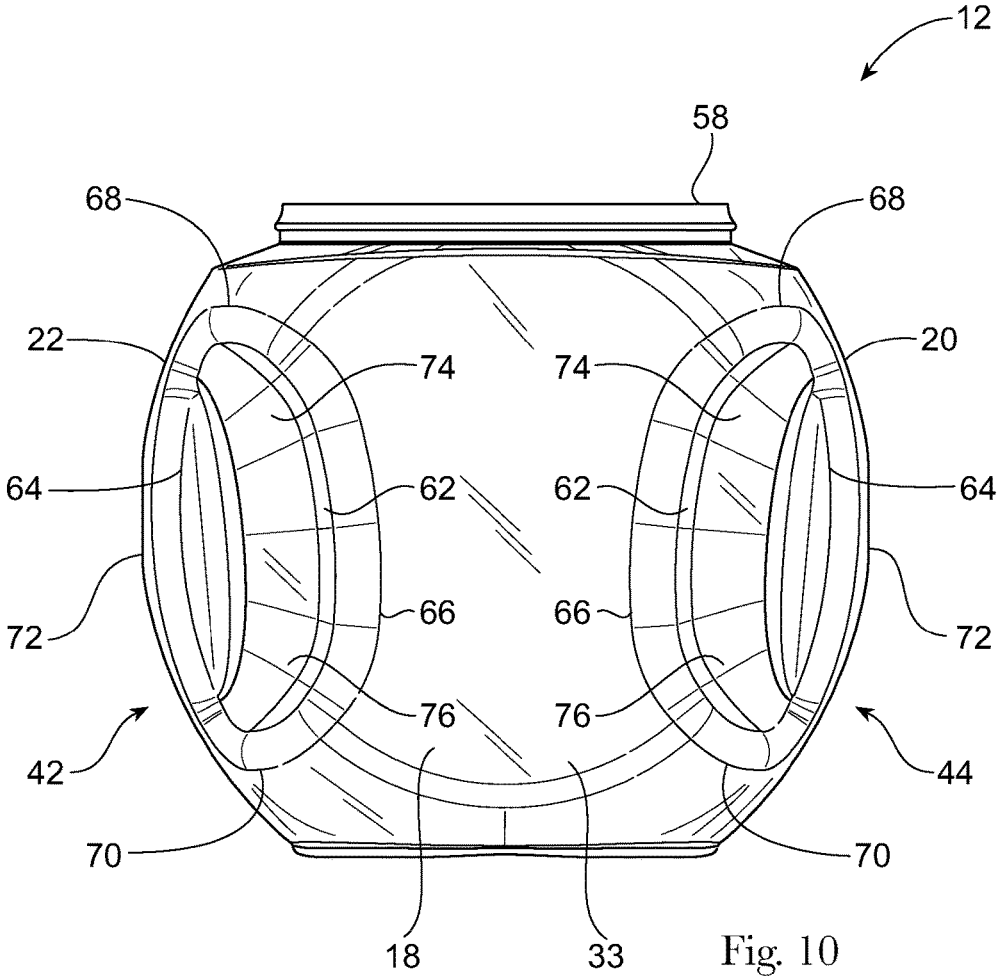
FIG. 10 is a rear view of the tub of FIG. 5.
Figure 11:
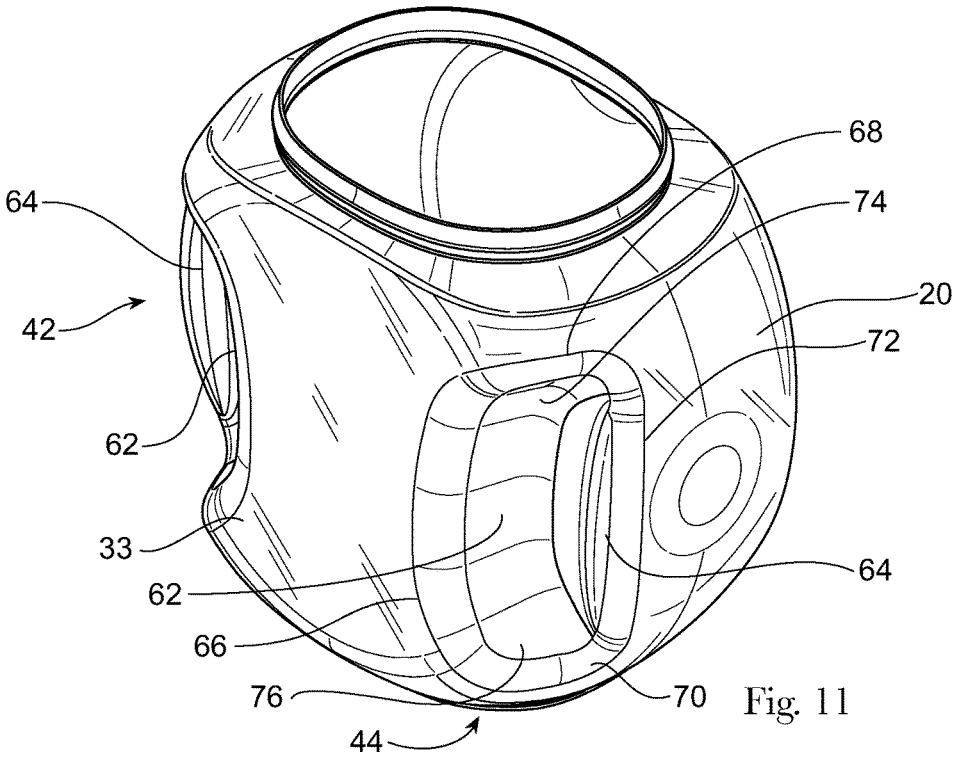
FIG. 11 is a perspective rear view of the tub of FIG. 5.
Figure 12:
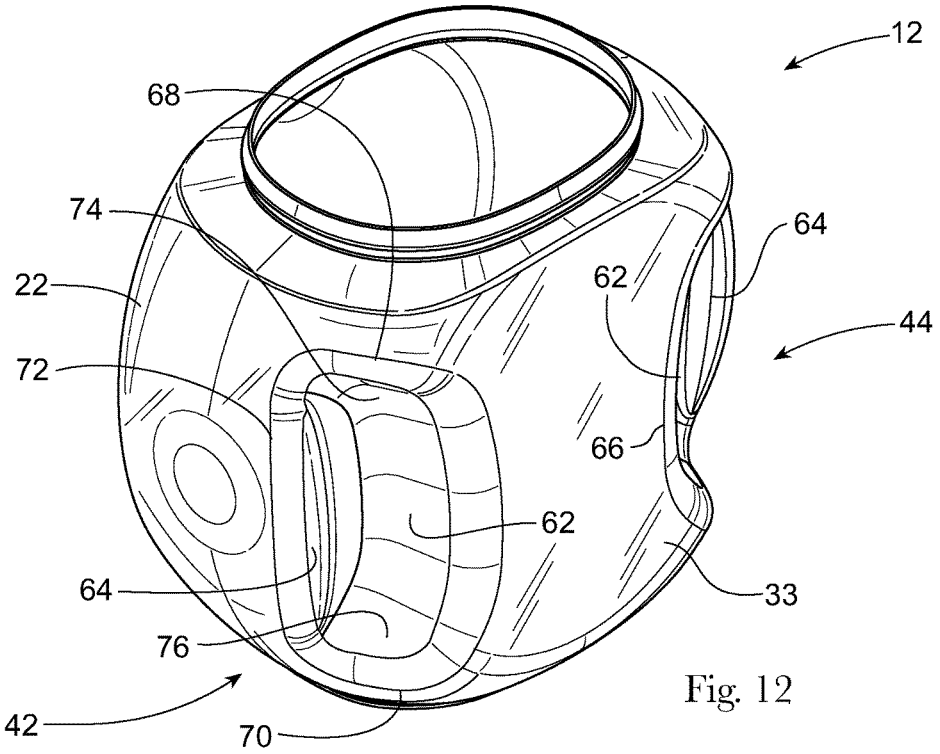
FIG. 12 is another perspective rear view of the tub of FIG. 5.

Referring to FIGS. 10-12, the tub 12 may include the handle structures 42 and 44. In the illustrated embodiment, the handle structures 42 and 44 are formed integrally with the rear wall 18 of the tub 12 and each include an inwardly extending portion 62 that extends generally toward the front wall 16 and an outwardly extending portion 64 that extends generally toward the respective side wall 20 or 22. The inwardly extending portions 62 may each include a somewhat arcuate rear edge 66 that intersects the rear face 33 and top and bottom edges 68 and 70 that intersect the side walls 20 and 22. In some embodiments, the top edge 68 and the bottom edge 70 may extend relatively horizontally and somewhat parallel to each other. The outwardly extending portion 64 may include an outer edge 72 that extends somewhat vertically along the periphery of the side walls 20 and 22.

In some embodiments, the inwardly extending portions 62 may have a contour that is curved from an upper portion 74 to a lower portion 76, forming a somewhat C-shape that can be used to guide a user's fingers toward a center of the handle structures 42 and 44 and to also provide an upper overhang and a lower underhang to aid in grasping the tub 12. The inwardly extending portions 62 may also have a contour that slants and/or curves outwardly toward the side walls 20 and 22 that can be used to guide the user's fingers toward the outwardly extending portions 64. In some embodiments, the outwardly extending portions 64 may be somewhat planar or flat or may be slanted and/or curved. In some embodiments, the outwardly extending portions 64 may have a contour that is curved from the top edge 68 to the bottom edge 70. The outwardly extending portions 64 may include features such as ribs, recesses, elastomeric materials, and the like to aid in grasping the tub 12 at the handle structures 42 and 44.

The exemplary handle structures 42 and 44 can provide multiple grasping possibilities for a user. For example, the user may grasp the container system 10 at any one of the handle structures 42 or 44 to hold the container system 10 in a single hand. In another instance, the user may grasp the container system 10 with both hands, one hand grasping handle structure 42 and 44, respectively, for example, with fingers located at the outwardly extending portions 64 and thumbs located at the front wall 16. As another example, the user can grasp across both handle structures 42 and 44 using one hand with fingers located at one of the inwardly extending portions 62 and the thumb located at the other inwardly extending portion 62. Thus, multiple grasping positions, e.g., three or more, can be used in utilizing the handle structures 42 and 44.

Figure 13:
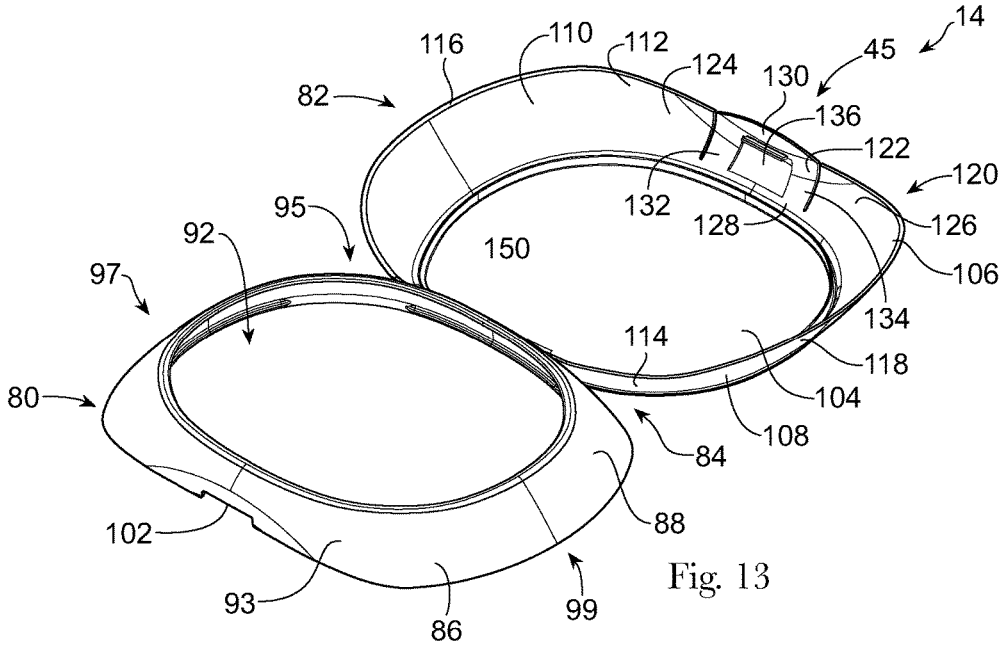
FIG. 13 is a perspective top view of an embodiment of a lid for use with the container system of FIG. 1.
Figure 14:
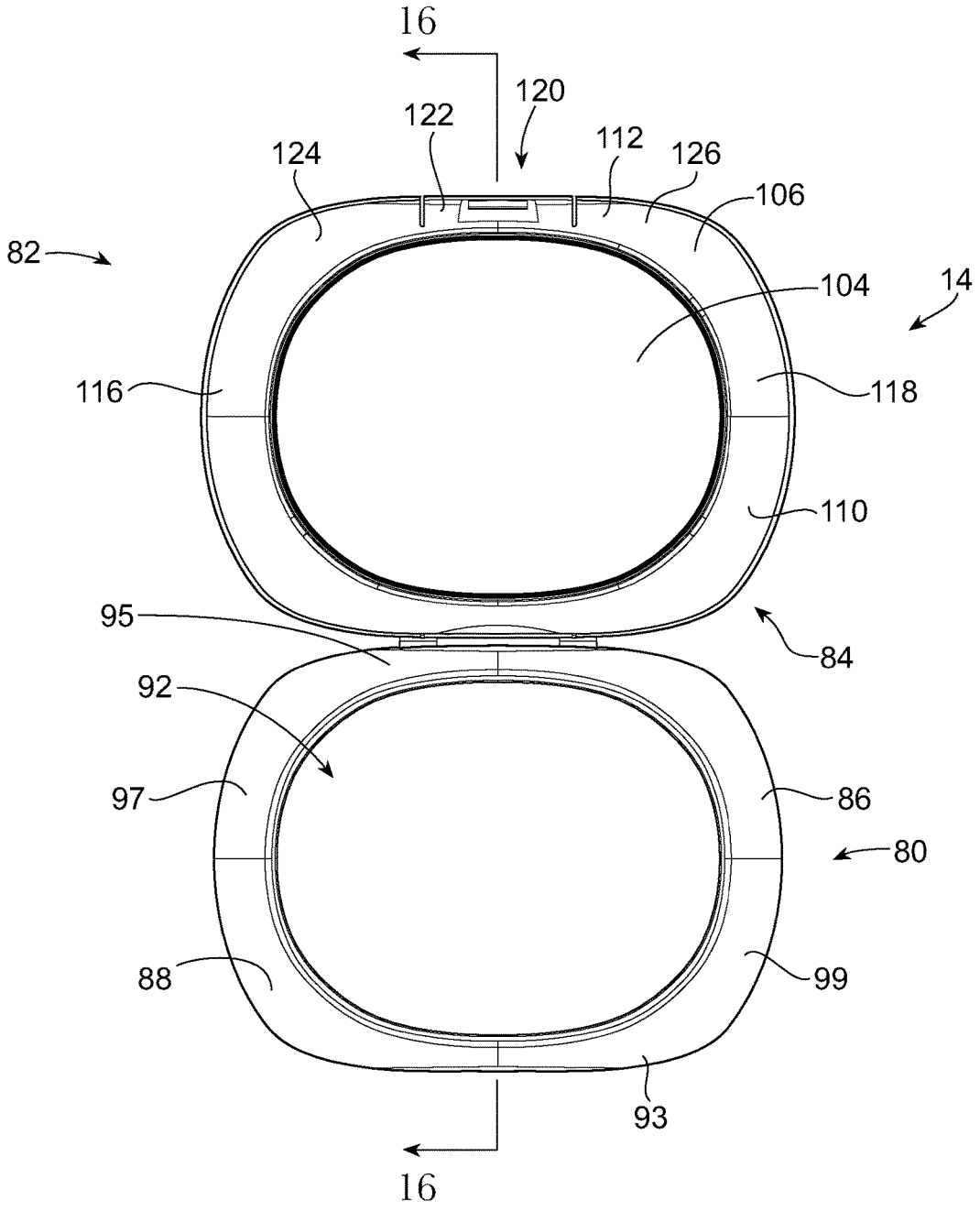
FIG. 14 is a top view of the lid of FIG. 13.
Figure 15:
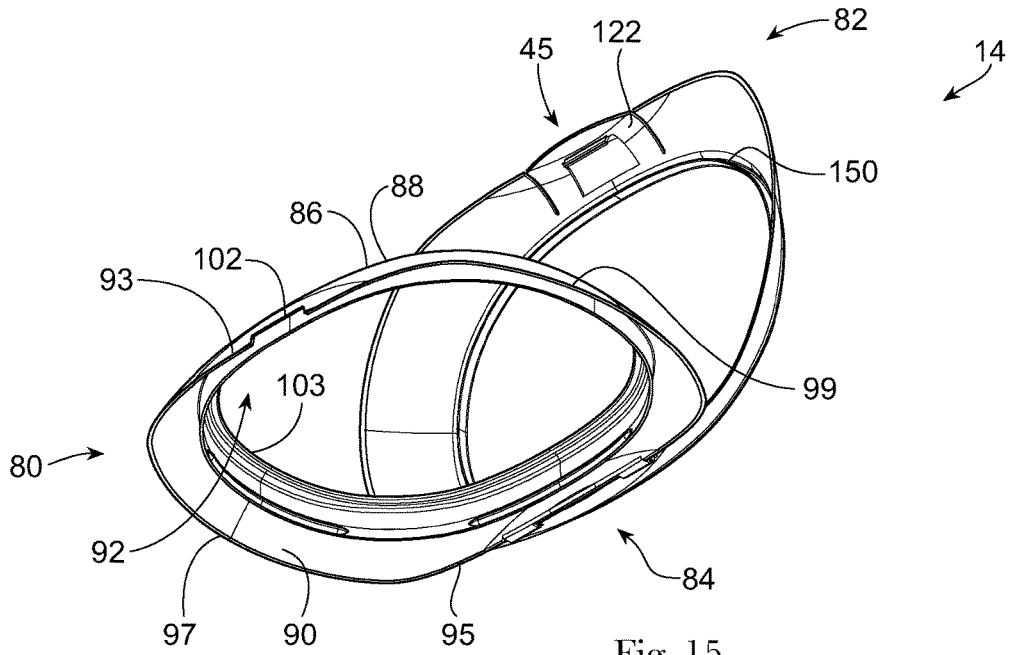
FIG. 15 is a perspective bottom view of the lid of FIG. 13.

Referring now to FIGS. 13-15, the lid 14 is illustrated in isolation, removed from the tub 12. The lid 14 generally includes a tub connecting portion 80 that connects the lid 14 to the tub 12 and a lid closure portion 82 that is moveable relative to the tub connecting portion 80 between open and closed configurations. In some embodiments, the lid closure portion 82 may be moveably connected to the tub connecting portion 80 (e.g., by a hinge structure 84 such as one or more living hinges) such that the lid closure portion 82 may be moved (e.g., pivoted) relative to the tub connecting portion 80 between the open and closed configurations while remaining connected to the tub connecting portion 80. In other embodiments, the lid closure portion 82 may be removably connected to the tub connecting portion 80 such that the lid closure portion 82 can be completely separated from the tub connecting portion 80.

The tub connecting portion 80 includes a shoulder covering 86 having an outer-facing surface 88 that faces away from the tub 12 and a tub-facing surface 90 (FIG. 15) that faces toward the tub 12. An opening 92 extends through the shoulder covering 68 that is sized and arranged to align with the opening 65 of the tub 12. In some embodiments, the shoulder covering 86 extends continuously about the opening 92 and includes a front 93, a back 95 and sides 97 and 99. While FIGS. 13-15 illustrate a continuous shoulder covering 86, other configurations are contemplated such as a segmented shoulder covering.

Figure 16:
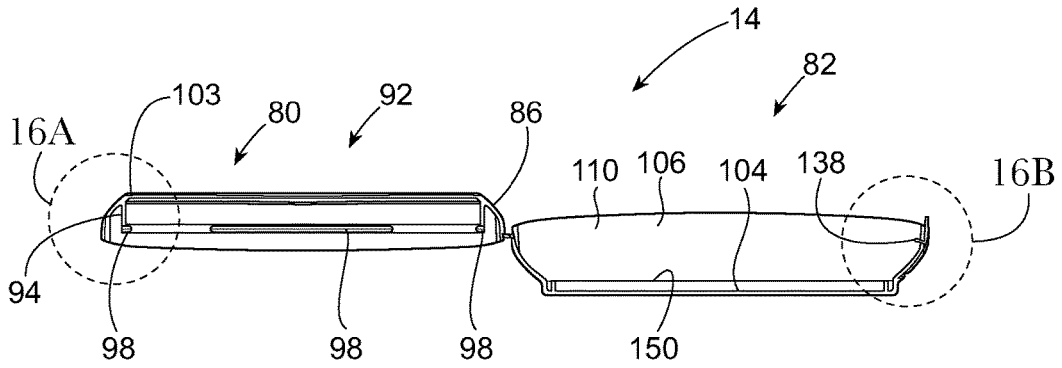
FIG. 16 is a section view along line 16-16 of FIG. 14.
Figure 16A:
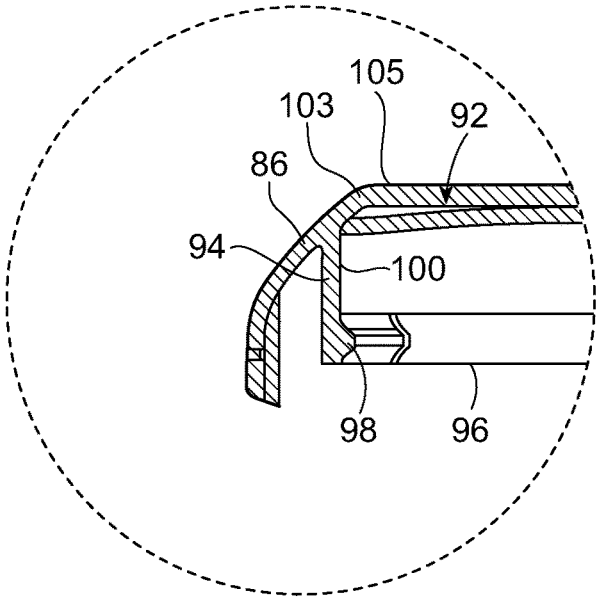
FIG. 16A is a detail view at area A of FIG. 16.

Referring to FIG. 16 illustrating a cross-section of the exemplary lid 14, a tub connecting lip 94 may extend vertically downward from the shoulder covering 86 to a free end 96. The tub connecting lip 94 is also illustrated by FIG. 16A. In some embodiments, the tub connecting lip 94 may extend continuously about the opening 92. In other embodiments, multiple, discontinuous tub connecting lips may be provided. At the free end 96 of the tub connecting lip 94 is an engaging feature such as a rib 98 that extends outwardly from a tub facing surface 100 of the tub connecting lip 94. The rib 98 may extend continuously along the tub facing surface 100 about the opening 92, or, such as in the illustrated embodiment, the multiple ribs 98 may be provided at selected locations about the opening 92. In the illustrated embodiment, discrete rib segments 98 are provided at the sides, front and back of the opening 92 as shown in FIG. 16. Above the tub connecting lip 94 and extending horizontally into the opening 92 is a sealing lip 103. As will be described below, the ribs 98 engage the rib 60 of the mouth structure 56 to releasably connect the lid 14 to the tub 12 and the sealing lip 103 provides a sealing surface 105 for engaging a sealing feature (e.g., sealing lip 150 shown in FIGS. 13, 15, 16, and 16B) carried by the lid closure portion 82.

Referring back to FIG. 13, a notch 102 may be provided at the front of the tub connecting portion 80. The notch 102 may provide a latch engaging feature of the latch system 45 for latching the lid closure portion 82 in the closed configuration. In other embodiments, the notch 102 may not be provided. For example, a bottom edge of the tub connecting portion 80 may provide the latch engaging feature.

Referring again to FIGS. 13 and 14, the lid closure portion 82 includes a top 104 and a hood 106 extending outwardly (e.g., substantially radially outward from the top) and downwardly from the top 104. As can be seen, the hood 106 may be somewhat curved in contour and may have an outer-facing surface 108 that faces away from the tub 12 and a tub-facing surface 110 that faces toward the tub 12. The hood 106 may extend continuously about the top 104 and include a front 112, a rear 114 and sides 116 and 118. The hood 106 may be sized and shaped to cover all or some portion of the shoulder covering 86 of the tub connecting portion 80 with the lid closure portion 82 in the closed configuration as will be described in greater detail below.

The lid closure portion 82 is provided with a latch engaging feature 120 of the latch system 45. In the illustrated exemplary embodiment, the latch engaging feature 120 includes a cantilevered latch member 122 that is configured for movement between latched and unlatched positions. In some embodiments, the latch member 122 may be formed of the same material forming the adjacent hood portions 124 and 126, which may have sufficient flexibility and resiliency to allow the latch member 122 to be repeatedly moved between the latched and unlatched positions. In some embodiments, the material forming the latch member 122 may have sufficient resiliency to bias the latch member toward the illustrated latched position. A self closing latch system 45 may also be provided where enough biasing force is provided by the material to automatically return the latch member 122 to the latched position. While the latch member 122 may be formed of material forming the adjacent hood portions 124 and 126, the latch member 122 may also be formed of a different material.

Figure 16B:
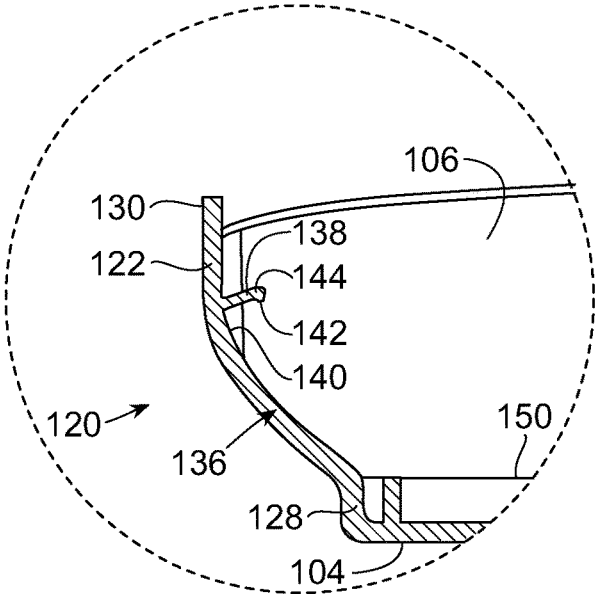
FIG. 16B is a detail view at area B of FIG. 16.

Referring also to FIGS. 13 and 16B, the latch member 122 includes an upper portion 128 connected to the hood 106, a lower portion 130 and side portions 132 and 134 that extend between the upper portion 128 and the lower portion 130. A window 136 is provided between the upper portion 128, the lower portion 130 and the side portions 132 and 134. Referring particularly to FIG. 16B, an engagement member 138 projects outwardly from a tub facing surface 140 of the latch member 122 at the lower portion 130. In some embodiments, the engagement member 138 is in the form of a projection that projects integrally from the latch member 122 toward the tub 12 with the latch member 122 in the closed position as illustrated by FIG. 16B. The engagement member 138 may extend outwardly at an angle of less than, at or greater than 90 degrees from the horizontal with the latch member 122 in the closed position. In some embodiments, the engagement member 138 is hook-shaped having a hook portion 142 that extends outwardly and upwardly from a projecting portion 144 of the engagement member 138. In embodiments where the engagement member 138 is hook-shaped, the window 136 can facilitate forming of the hook portion 142 during formation of the lid 14.

Referring to FIGS. 13-16B, a sealing rib 150 may extend outwardly from the top 104 of the lid closure portion 82. In some embodiments, the sealing rib 150 extends continuously about a periphery of the top 104, forming a continuous sealing ring. The sealing rib 150 extends outwardly from the top 104 to cooperate with the sealing lip 103 of the tub connecting portion 80 to provide a seal with the lid closure portion 82 in its closed position.

Figure 17:
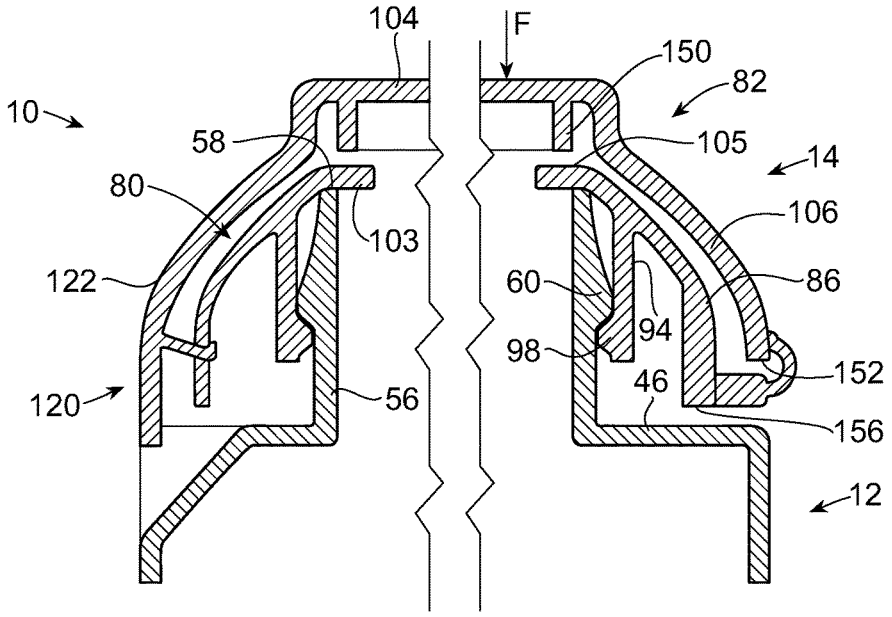
FIG. 17 is a diagrammatic section view of the container system of FIG. 1 showing the lid attached to the tub.

Referring to FIG. 17, a diagrammatic, side section view of the lid 14 is illustrated connected to the tub 12 with the lid closure portion 82 in the closed position. The lid 14 may be connected to the tub 12 by aligning the tub connecting lip 94 of the lid 14 with the mouth structure 56 of the tub 12. A closing force may be applied in the direction of arrow F and the force may be transferred through the sealing rib 150 of the lid closure portion 82 to the sealing lip 103 of the tub connecting portion 80, which can be used to push the rib 98 of the tub connecting lip 94 past the rib 60 of the mouth structure 56 thereby removably connecting the lid to the tub 12. In some embodiments, the tub connecting lip 94 has sufficient flexibility to deflect to allow the rib 98 to pass the rib 60 and resiliency to engage the rib 60 to provide resistance to removing the lid 14. As can be seen by FIG. 17, the lid 14 may be completely external to the tub 12. In other embodiments, the lid 14 may include one or more components located within the tub 12.

With the tub connecting lip 94 engaged with the mouth structure 56, the shoulder covering 86 of the tub connecting portion 80 may extend generally outwardly away from the mouth structure 56 and downwardly toward the shoulder 46 of the tub 12. The hood 106 may also extend outwardly away from the mouth structure 56 and downwardly toward the shoulder 46, covering at least part of the shoulder covering 86 and having an end 152 located nearer the outer edges of the shoulder 46 of the tub 12 than an edge 156 of the shoulder covering 86. As can be appreciated, the hood 106 may provide a larger footprint on the shoulder 46 than the shoulder covering 86. The end 152 may be located internal or external of the outer edges of the shoulder 46.

The sealing lip 103 extends generally horizontally over the upper edge 58 of the mouth structure 56. In some embodiments, the sealing lip 103 may rest against the upper edge 58 of the mouth structure 56. With the latch engaging feature 120 in the locked configuration, the sealing rib 150 extends downwardly from the top 104 toward the sealing surface 105 of the sealing lip 103. In some embodiments, the sealing rib 150 engages or rests against the sealing surface 105 with the latch engaging feature 120 in the locked configuration. In another embodiment, a gap may be present between the sealing rib 150 and the sealing surface 105 with the latch engaging feature 120 in the locked configuration. Whether a gap is present or not between the sealing rib 150 and the sealing surface 105, the lid 14 may be configured to inhibit moisture from entering the tub 12. As one example, the lid 14 may allow less than about 1 g/day/liter of moisture into the tub when in its closed configuration, such as less than about 0.8 g/day/liter, such as less than about 0.6 g/day/liter, such as less than about 0.5 g/day/liter.

Figure 18:
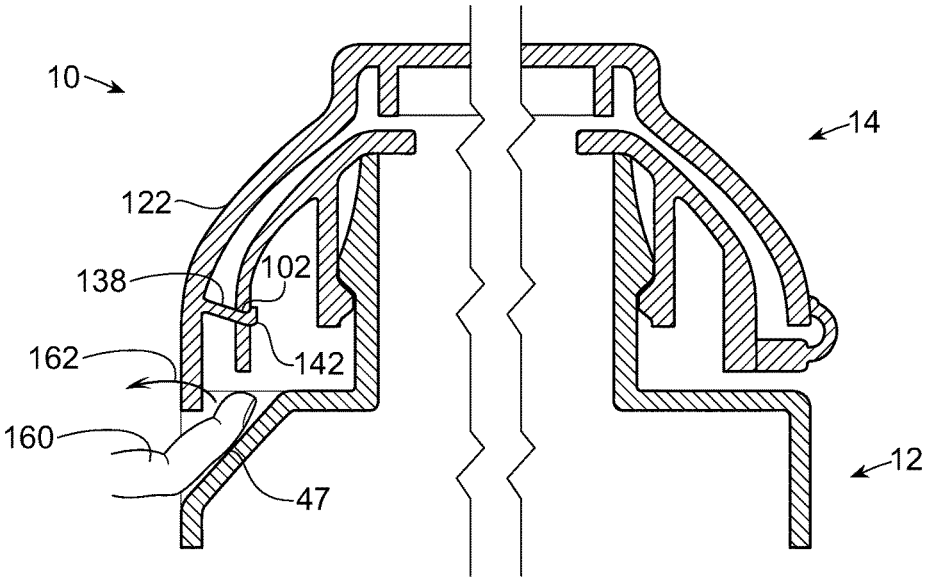
FIG. 18 illustrates an embodiment of a method for opening the lid of FIG. 17.
Figure 19:
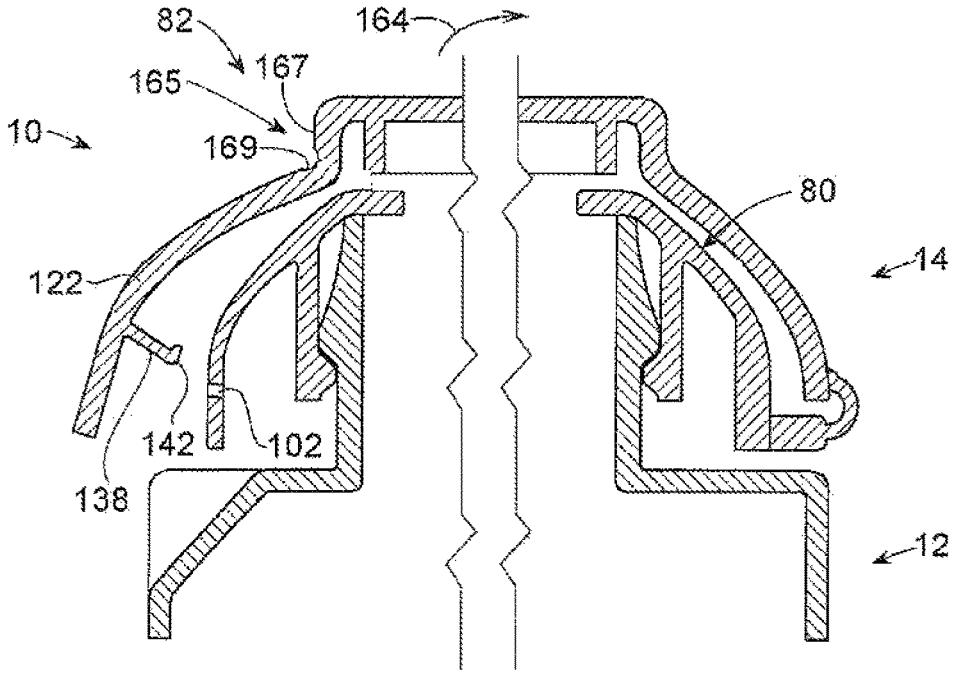
FIG. 19 illustrates the method of FIG. 18.
Figure 20:
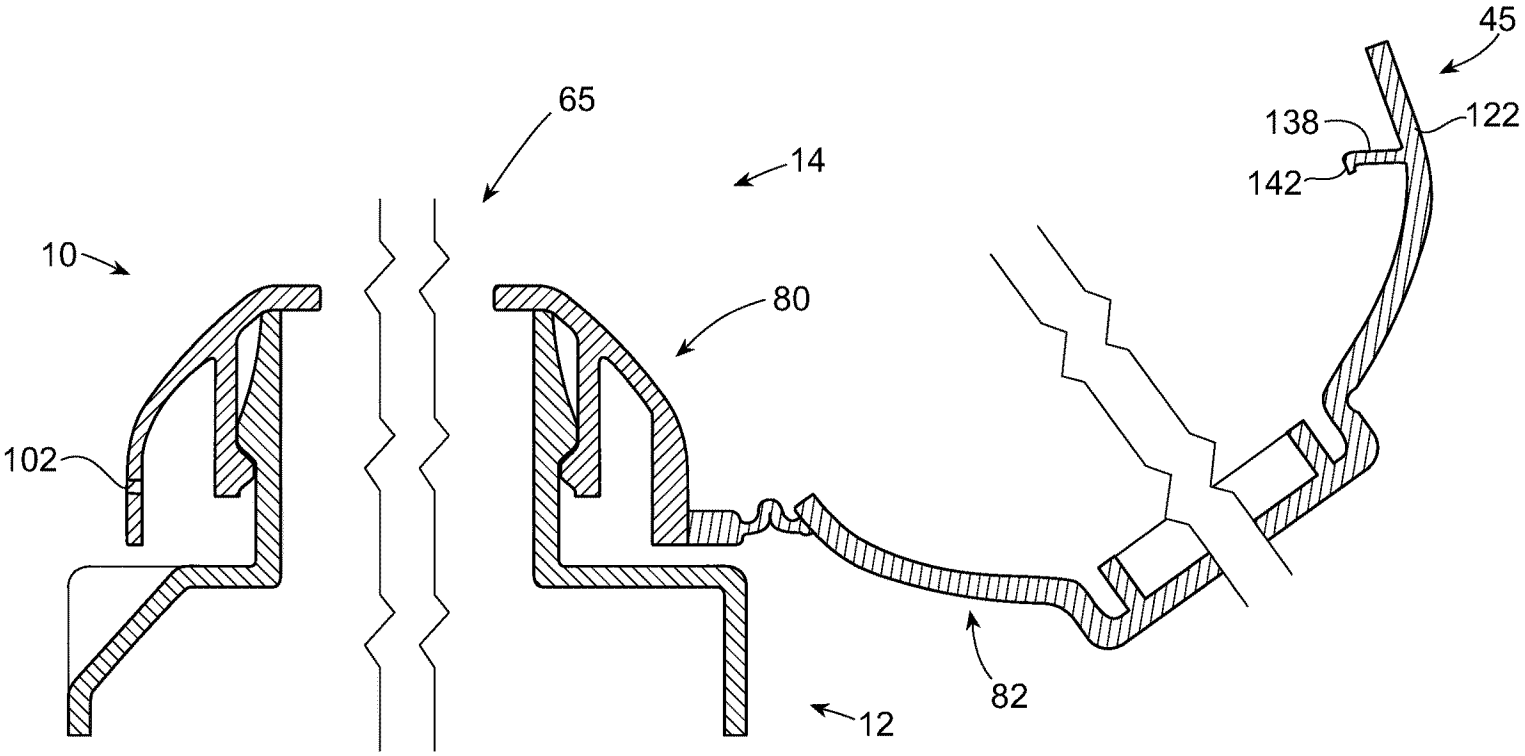
FIG. 20 illustrates the method of FIG. 18.

FIGS. 18-20 illustrate a method of opening the lid 14, for example, using only one hand. In some embodiments, both hands may be used. Referring to FIG. 18, one or more fingers 160 may be located at the recess 47, between the latch member 122 and the tub 12. Pulling on the latch member 122 in the direction of arrow 162 can pull the engagement member 138 and the hook portion 142 from beneath the notch 102 as illustrated by FIG. 19. Once the engagement member is released, the lid closure portion 82 may be moved relative to the tub connecting portion 80 in the direction of arrow 164. In some embodiments, the latch member 122 includes a line of weakness 165 located on an external surface 167 of the latch member 122. In these embodiments, it may be possible to raise the latch member 122 only a certain amount before opposite edges 169 and 171 come into contact, inhibiting further movement of the latch member 122. In these embodiments, such an arrangement can facilitate using the latch member 122 as a handle for opening the lid closure portion 82. In other embodiments, the line of weakness may be located on the opposite internal surface of the latch member 122. Referring to FIG. 20, the lid closure portion 82 may then rest in the open configuration to expose the opening 65 in the tub 12 so that contents may be removed from the storage volume of the tub 12. Once the contents are removed, the above steps may be performed in reverse to place the lid closure portion 82 in the closed position with the latching system 45 in the latched configuration. In some embodiments, the engagement member 138 may contact the shoulder covering 86 above the notch 102 when latching the latching system 45. Force applied to the latch member 122 may deflect the engagement member 138, which causes the latch member 122 to snap into place. This snap can provide an audible and/or tactile indication (i.e., signal to the user) that the latching system 45 is in the latched configuration.

The above tub 12 and lid 14 may be formed by any suitable method utilizing any suitable materials. In some embodiments, the tub 12 may be molded (e.g., injection stretch blow molded) from a suitable plastic material such as polyethylene terephthalate. Any suitable polyolefins and/or polyesters may be used. The lid 14 or portions thereof may be formed partially or wholly of a moldable thermoplastic material, such as polypropylene, polyethylene, polystyrene, acrylonitryl butadiene styrene (ABS), polyester, polyvinyl chloride, polycarbonate or elastomer, or a blend of these materials. In some embodiments, the tub 12 is formed of a clear, transparent or semi-transparent material, while the lid 14 is formed of an opaque material. In another embodiment, the lid 14 may be formed translucent. In one embodiment, the lid closure portion 82 may be formed using differential mold half temperatures to pre-shape (or pre-warp) the lid closure portion 82. In such embodiments, the lid closure portion 82 may impart a sealing force against the sealing surface 105 once the lid closure portion 82 is in the closed configuration.

Figure 21:
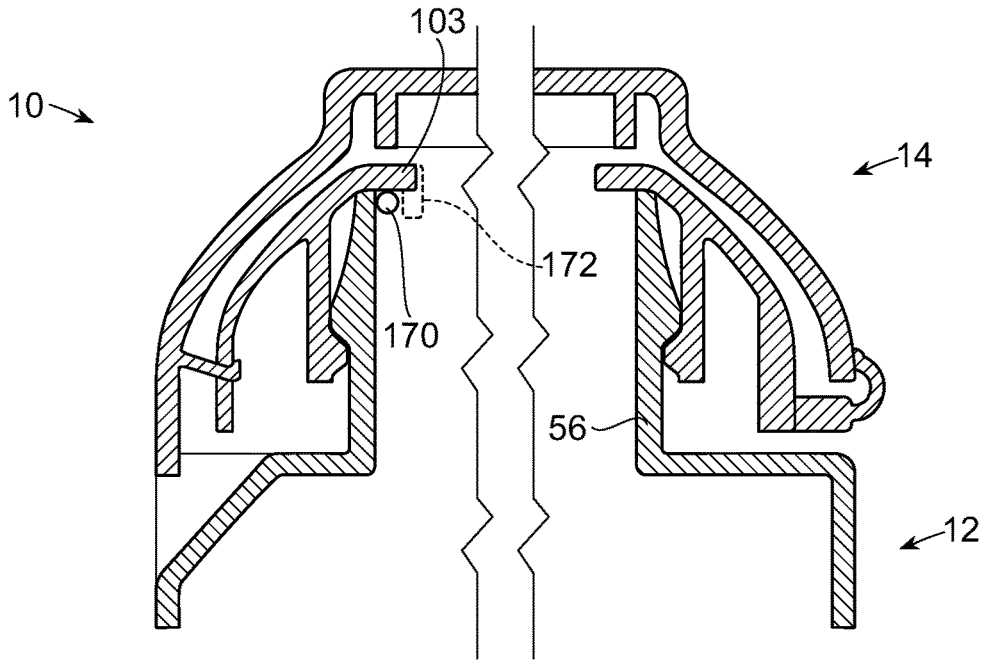
FIG. 21 is a diagrammatic section view of another embodiment of a container system.

Referring now to FIG. 21, in some embodiments, a bead 170 of a perfume-comprising hot melt adhesive may be adhered to one or both of the tub 12 and the lid 14. A "hot melt adhesive" is a polymeric composition which has been melted, delivered and adhered to the container system 10 on cooling. The composition may be adhesive per se and may not require adhesive aids in order to adhere to the container system 10. While the bead 170 is illustrated as being adhered at the front of the mouth structure 56, the bead 170 may be adhered to any one or more other locations along the mouth structure 56 and/or within the tub 12. In some embodiments, the sealing lip 103 may be used to overhang the bead 170 to obscure or block the bead 170 from vision when looking into the opening 65 of the tub 12. In another embodiment, represented by dotted lines 172, a wall may be provided to hide the bead 170 therebehind.

The hot melt may slowly release perfume, providing a pleasant smell each time that the container system 10 is opened. Some embodiments provide a pleasant smell each time that the pack is handled (even before it is opened). The hot melt adhesive may include, for example, an aldehyde-comprising perfume. Suitable aldehydes for use herein are those traditionally used in perfumes and can be found in "Perfume and Flavor Chemicals", Vol. I and II, S. Arctander, Allured Publishing, 1994, ISBN 0-931710-35-5. Suitable aldehydes include C6-C14 aliphatic aldehydes, C6-C14 acyclic terpene aldehyde and mixtures thereof. The perfume component may be selected from C8-C12 aliphatic aldehydes, C8-C12 acyclic terpene aldehydes and mixtures thereof. The perfume component may be selected from the group consisting of citral; neral; isocitral; dihydro citral; citronellal; octanal; nonanal; decanal; undecanal; dodecanal; tridecanal; 2-methyl decanal; methyl nonyl acetaldehyde; 2-nonen al; decanal; undecenal; undecylenic aldehyde; 2, 6 dimethyl octanal; 2, 6, 3, 10, trimethyl undecen-1-al; trimethyl undecanal; dodecenal; melonal; 2-methyl octanal; 3, 5, 5, trimethyl hexanal and mixtures thereof. The perfumes for use in the hot melt may comprise at least about 1% of aldehydes, such as at least about 2% and such as at least about 4% by weight of the perfume composition.

The amount of hot melt adhesive placed on the interior of the packaging container depends on the size, specially the amount of headspace, thereof and the number and size of pouches contained therein. For example, a packaging container containing 12 polyvinyl alcohol pouches of a volume of about 20 ml wherein the pouches occupy more than about 40%, preferably more than about 60% and more preferably more than about 70% of the interior volume of the packaging container, would require from about 0.05 to about 0.3 grams of hot melt adhesive—the hot melt comprising from about 40% to about 60% of aldehyde comprising—perfume—preferably from about 0.1 to about 0.2 grams.

One component of the hot melt adhesive for use herein is a copolymer of ethylene with at least another monomer comprising at least a heteroatom. All copolymers of ethylene with at least another monomer comprising at least a heteroatom are suitable for use herein.

The term "monomer comprising at least a heteroatom" includes all those monomers which comprise at least a C-X linkage wherein X is not C or H. The C-X linkage may be a polar linkage. The carbon atom may be linked to an N, S, F, Cl or O atom. The polar linkage may be part of a carbonyl group and particularly of an ester group. Examples of monomers comprising at least a heteroatom are vinyl acetate, vinyl alcohol, methyl acrylate, ethyl acrylate, butyl acrylate, acrylic acid and salts formed therefrom, methacrylic acid and salts formed therefrom, maleic anhydride, glycidyl methacrylate and carbon monoxide.

Suitable copolymers for use herein can be both block and non-block copolymers, grafted copolymers, copolymers with side chains, or crosslinked and copolymers where ethylene monomers are randomly copolymerized with monomers comprising at least a heteroatom.

Suitable copolymers of ethylene include ethylene-vinyl ester copolymers, ethylene-acrylic ester copolymers, ethylene-methacrylic ester copolymers, ionomers, ethylene-acrylic acid copolymers, ethylene-methacrylic acid copolymers, ethylene-vinyl ester-acrylic acid copolymers, ethylene-vinyl ester-methacrylic acid copolymers, ethylene-vinyl ester-maleic anhydride copolymers, ethylene-acrylic ester-maleic anhydride copolymers, ethylene-vinyl ester-glycidyl methacrylate copolymers, ethylene-acrylic ester-glycidyl methacrylate copolymers, ethylene-maleic anhydride copolymers, ethylene-glycidyl methacrylate copolymers The monomer comprising at least a heteroatom in the copolymers suitable for use represents from about 10% to about 90% of the total weight of the copolymer, preferably at least about 14% more preferably at least about 18%.

Some exemplary copolymers include ethylene-vinyl acetate copolymers such as those sold under the trade names ELVAX by Dupont, EVATHANE by Atofina, ESCORENE by Exxon and LEVAPREN and LEVAMELT by Bayer and ethylene-acrylic ester copolymers such as those sold under the trade name LOTRYL by Atofina.

Another component of the hot melt adhesive for use herein is a plasticizer or mixture of plasticizers comprising at least one heteroatom, compatible with the copolymer of ethylene with at least another monomer comprising at least a heteroatom. The term "plasticizer comprising at least a heteroatom" includes all those plasticizers which comprise at least a C-X linkage in the molecule wherein X is not C or H. Said C-X linkage may be a polar linkage. The carbon atom may be linked to an N, S, F, Cl or O atom. Said polar linkage may be part of a carbonyl group and particularly of an ester group.

Suitable plasticizers for use herein include citric acid esters, low molecular weight polyesters, polyethers, liquid rosin esters, aromatic sulfonamides, phthalates, benzoates, sucrose esters, derivatives of polyfunctional alcohols (where polyfunctional means having 2 or more hydroxyl groups), adipates, tartrates, sebacates, esters of phosphoric acid, fatty acids and diacids, fatty alcohols and diols, epoxidized vegetable oils etc and mixtures thereof. The different polarity of the different compatible plasticizers (measurable with any method known to those skilled in the art, for example water/octanol partition coefficient) can be used to tune the polarity of the polymeric matrix in order to provide a better match with the polarity of the volatile material.

The hot melt adhesive composition may comprise from about 5% to about 75%, such as from about 10% to about 50% by weight of the composition, of the copolymer of ethylene with at least another monomer comprising at least a heteroatom; from about 10% to about 60%, such as about 15% to about 40% by weight of the composition, of the compatible plasticizer or blend of plasticizers comprising at least one heteroatom, and more than about 20%, such as more than about 30%, such as more than about 40% of a perfume; the volatile material is preferably comprised up to a maximum percentage of about 80% by weight of the composition.

The polymeric hot melt adhesive may, in addition, comprise additional optional components to further improve the processability of the compositions and also the mechanical characteristics as well as other characteristics as tackiness, resistance to ageing by light, oxygen and heat, visual appearance etc., of the objects formed from such polymeric compositions.

Such optional components may include other copolymers that can be included in the formulations to improve their properties for example to increase adhesion or compatibility with substrates. To this purpose preferred optional copolymers are copolymers of styrene and at least one other vinyl or acrylic monomer, copolymers of poly(vinyl alcohol), polyamides, polyether amide copolymers, polyester amide copolymers, polyesters, polyether ester copolymers, polyurethanes, polyethers, poly(2-ethyl-2-oxazoline), copolymers of poly(vinyl pyrrolidone), polyacrylates, copolymers of polyvinyl ethers), etc.

The selected polymer, plasticizer and perfume can be blended together as a thermoplastic material. The resulting melt can then be dispersed in water, in one embodiment, at a temperature above its melting point, by mixing. Surfactant and/or stabilizing systems known to those skilled in the art can be employed to stabilize the resultant emulsion or dispersion.

Alternatively, a preformed aqueous polymeric dispersion or emulsion can be blended with the selected plasticizer and perfume. This can be done by adding the ingredients directly to the polymeric dispersion or emulsion, or e.g. by forming an aqueous dispersion of the perfume and plasticizer and blending this with the polymeric dispersion or emulsion. Both procedures result in the formation of an aqueous dispersion of a polymeric composition.

Alternatively, the polymeric dispersion can be formed in the presence of the plasticizer and/or of the perfume. This process can involve the solution or dispersion of monomers or prepolymers in water containing the dispersed volatile material and/or plasticizer. The polymerization can then be initiated to form the polymeric dispersion. If required, the perfume or plasticizer can be added subsequently to produce a dispersed polymeric composition.

The illustrative hot melt adhesive compositions for use herein, due to their rheology and to their adhesion properties, are particularly useful to be applied in the molten state onto a selected substrate, and directly adhered thereto. For example they can be readily applied to the inner surface of the tub 12 or the lid 14. Such application can be easily achieved during the manufacturing of the container system 10. The polymeric composition can be applied by means of a conventional hot melt delivery system. This system typically includes a melting unit, which maintains the hot melt at the temperature required to have a processable viscosity. The melting unit typically contains a pumping system capable of pumping the hot melt through a length of hose until it reaches the glue gun, or nozzle. The nozzle can have different geometries according to the desired application form of the glue (coatings, stripes, beads etc). In a typical embodiment, a slot nozzle can be used as the glue gun.

The perfume included in the hot melt adhesive may have a citrus character, i.e., a smell having a resemblance to lemon, orange, lime, grapefruit, etc, floral or other character. Citrus perfumes, for example, are associated with freshness and cleanness and are the preferred perfumes to use in some cleaning products.

In some embodiments, it may be desirable to provide the container system 10 with one or more features to facilitate assembly and/or transport. For example, the lids 14 and tubs 12 may be formed separately, then brought together for filling and assembly. It may also be desirable to shake or vibrate the tubs 12 while they are being filled and/or once they are filled with the unitized doses, which can reduce the volume occupied within the tubs 12 and settle the unitized doses.

Figure 22:
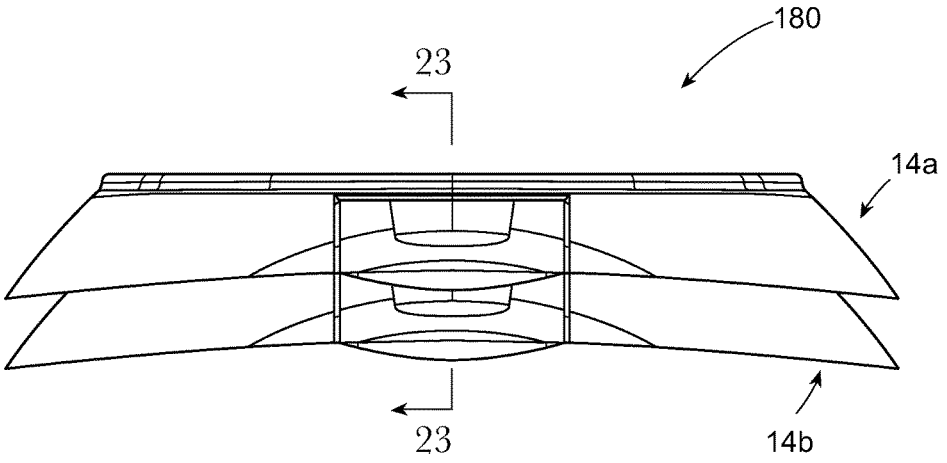
FIG. 22 is a front view of an embodiment of a stack of lids.
Figure 23:
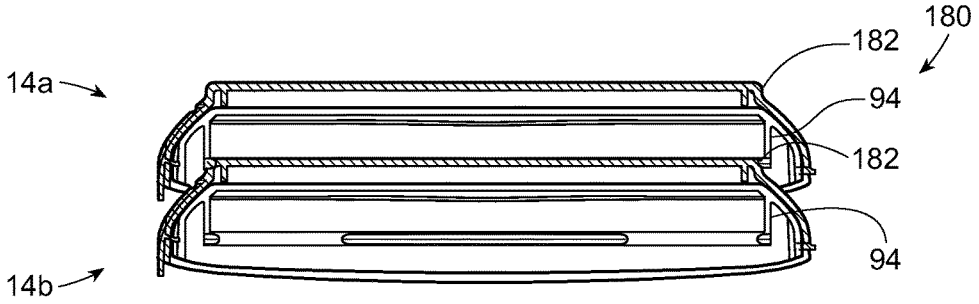
FIG. 23 is a section view along line 23-23 of FIG. 22.

Referring to FIGS. 22 and 23, a stack 180 of lids 14 are illustrated where an upper lid 14*a* is stacked on top of a lower lid 14*b*. Referring particularly to FIG. 23, the lids 14 may include an upwardly extending chimney structure 182 that extends into the space defined by the tub connecting lip 94. Such nesting between the chimney structure 182 and the tub connecting lip 94 can provided increased stability to the stack 180. While a stack of only two lids 14 is shown, the stack 180 may include any number of lids such as, for example, 10 or more lids 14. Additionally, ribs or other features may be added to the outer surface of the chimney structure 182 to tighten lid-to-lid fit. Adding height to the chimney may also help stack lids higher.

Figure 24:
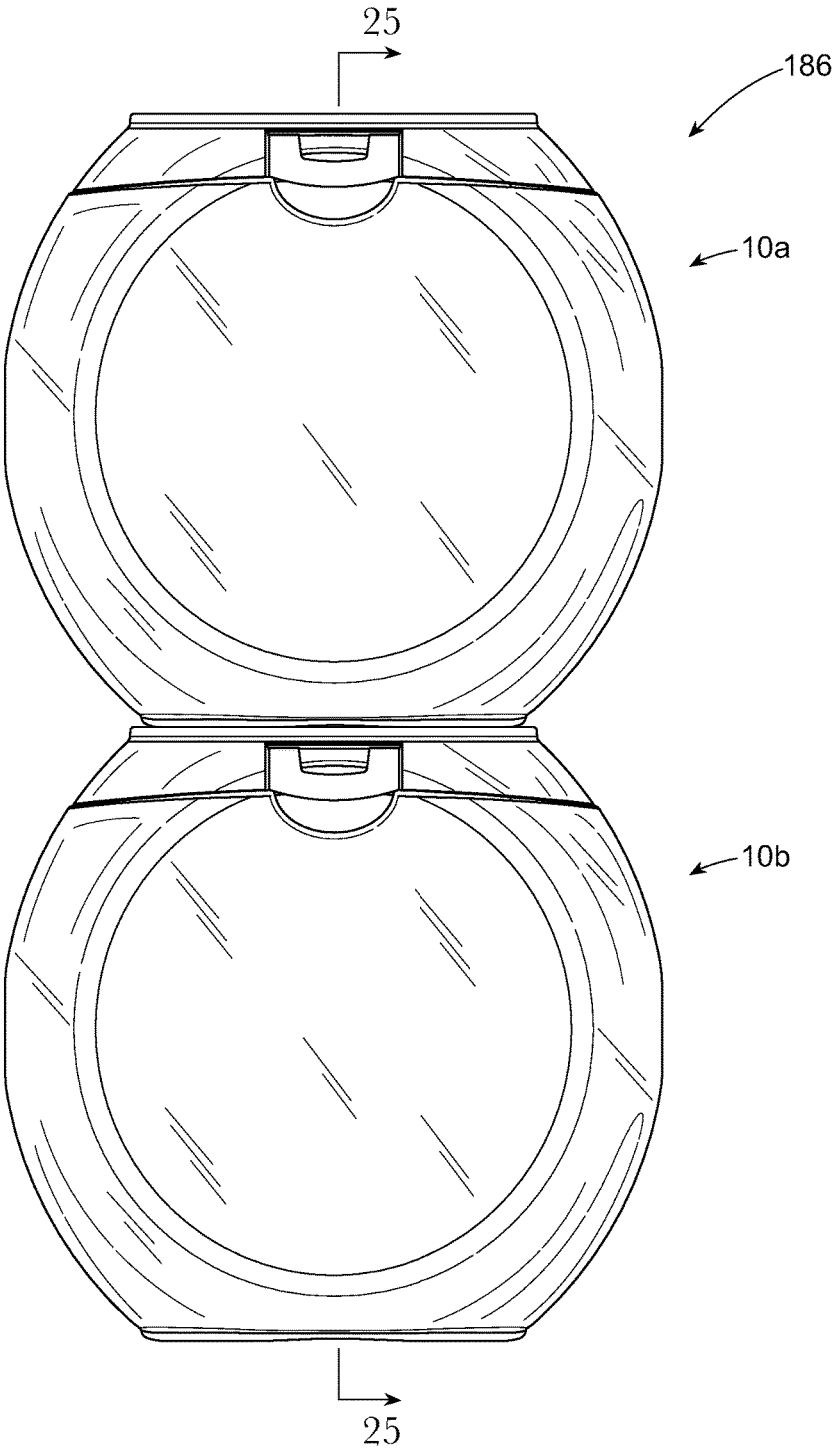
FIG. 24 illustrates an embodiment of a stack of the container systems of FIG. 1.
Figure 25:
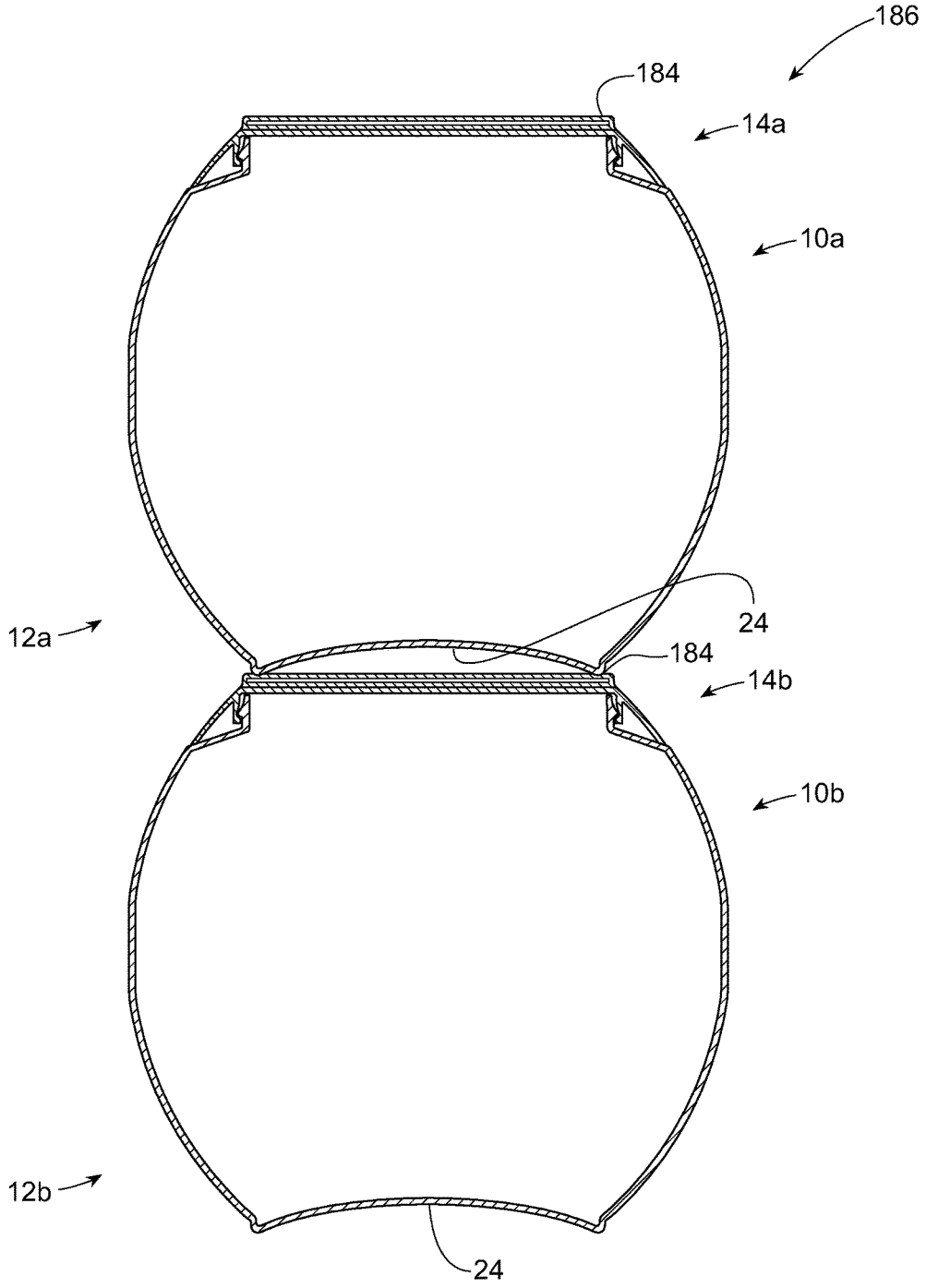
FIG. 25 illustrates a section view along line 25-25 of FIG. 24.

Referring to FIG. 24, the container systems 10 may also be provided with one or more features to facilitate stacking of the container systems 10, one on top of another (e.g., on a store shelf, on a pallet for transport, etc.) in a stack 186. Referring to FIG. 25, each lid 14 may include an upwardly extending ledge 184 extending about the periphery of the top on the lid 14. The ledge 184 may extend continuously or intermittently about the top thereby defining a receiving volume for the bottom 24 of the tub 12 to nest within. As can be seen, the footprint of the bottom 24 is less than the surface area of the top of the lid 14. Such nesting between upper and lower container systems 10*a* and 10*b*, respectively, can increase stability of container stacks on the shelf as well as during transport.

Figure 26:
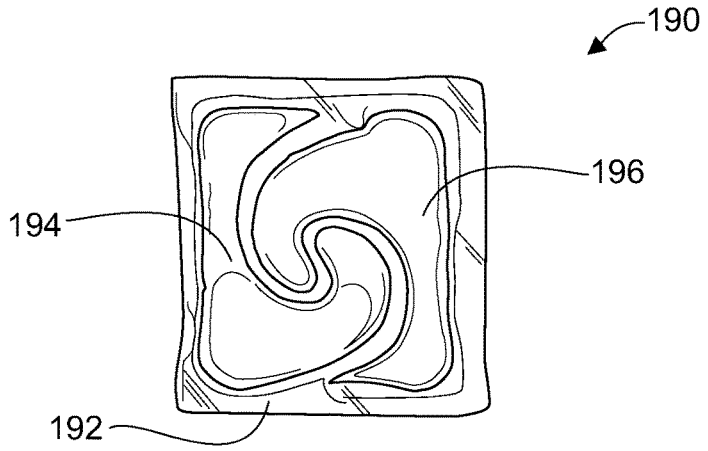
FIG. 26 illustrates an embodiment of a unit dose contained by the container system of FIGS. 1.

As indicated above, the above-described container systems 10 may contain unitized doses (e.g., counts of 50, 56, 84, 96, etc.) of a laundry detergent composition. One embodiment of a unitized dose 190 is illustrated by FIG. 26. In some instances, the unitized doses 190 may be pouches. The pouches may be a single compartment or include multiple compartments 192, 194 and 196. The pouches may contain various compositions, which may be of varying colors that may be seen from outside of the pouch. A multi-compartment pouch may contain the same or different compositions in each separate compartment. This multi-compartment feature may be utilized to keep compositions containing incompatible ingredients (e.g., bleach and enzymes) physically separated or partitioned from each other. It is believed that such partitioning may expand the useful life and/or decrease physical instability of such ingredients. Additionally or alternatively, such partitioning may provide aesthetic benefits as described in European Patent Application Number 09161692.0 (filed Jun. 2, 2009 and assigned to the Procter & Gamble Company), which is herein incorporated by reference in its entirety.

Non-limiting examples of useful compositions include light duty and heavy duty liquid detergent compositions, hard surface cleaning compositions, detergent gels commonly used for laundry, and bleach and laundry additives, shampoos, body washes, and other personal care compositions. Compositions of use in the present pouches may take the form of a liquid, solid or a powder. Liquid compositions may comprise a solid. Solids may include powder or agglomerates, such as micro-capsules, beads, noodles or one or more pearlized balls or mixtures thereof. Such a solid element may provide a technical benefit, through the wash or as a pre-treat, delayed or sequential release component; additionally or alternatively, it may provide an aesthetic effect.

In pouches comprising laundry compositions, the compositions may comprise one or more of the following non-limiting list of ingredients: opacifier; antioxidant; fabric care benefit agent; detersive enzyme; deposition aid; rheology modifier; builder; bleaching agent; bleach precursor; bleach catalyst; perfume; whitening agent; pearlescent agent; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents. Each of these ingredients is described in European Patent Application Number 09161692.0 (filed Jun. 2, 2009 and assigned to the Procter & Gamble Company), which is hereby incorporated by reference in its entirety. Additionally or alternatively, the compositions may comprise surfactants and/or solvent systems.

Figure 27:
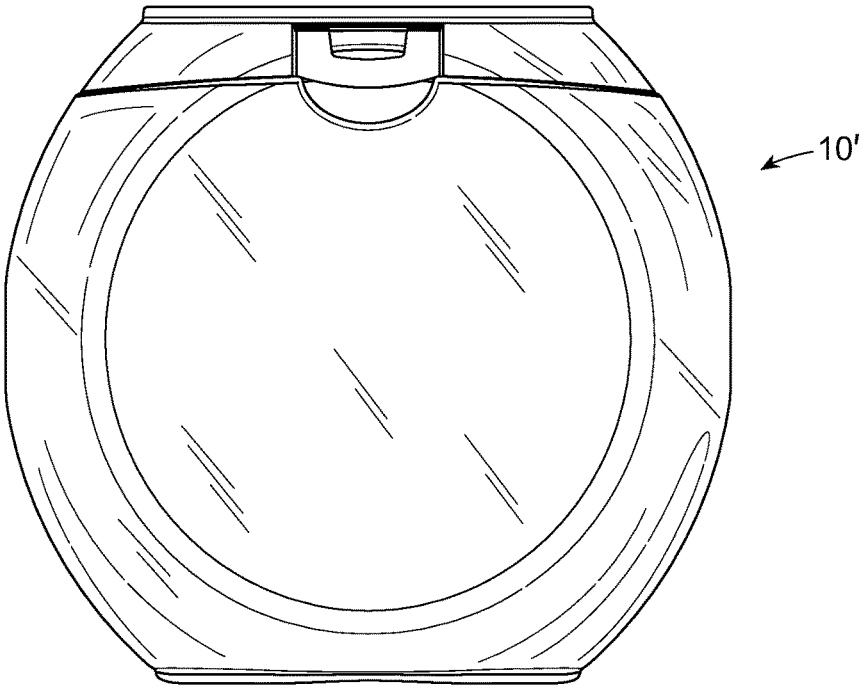
FIG. 27 is a perspective front view of another embodiment of a container system for containing unit doses having a different size that the container system of FIG. 1.

The above described container systems may provide a number of features such as ease of handling, versatility and/or sealing functions to protect the unitized doses from exposure to water while in the container system. The container systems may also be provided in a variety of sizes, for example, depending on the number of united doses to be contained therein. For example, FIG. 27 illustrates container system 10' of a differing size than that illustrated by FIG. 1. For example, container system 10' may be configured for carrying more unit doses. In some embodiments, the container system 10' may utilize the same lid 14 even though the container system 10' may accommodate more unit doses. The lid, when formed of an opaque material, can mask some of the empty volume at the top of the tub when the tub is formed of a clear material. For example, the lid may mask about five percent or more of the empty volume of the filled tub, such as about 10 percent or more.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container system comprising:

a. a tub comprising:

a front wall;

rear wall opposite the front wall;

side walls extending between the front wall and the rear wall, wherein the side walls have convex curvature;

a bottom extending between the front wall, rear wall and side walls;

a mouth structure connected to the front, rear, and side walls, the mouth structure including a fastening feature configured for connecting to a lid and having an opening there through that provides access to a containing volume of the tub; and a shoulder extending inwardly from the side walls to the mouth structure;

a plurality of unitized doses of a detergent composition within the containing volume of the tub, wherein the tub has: a maximum width ($W_1$) measured between the side walls of the tub; a maximum width ($W_2$) of the opening through the mouth structure; a maximum depth ($D_1$) measured between the front wall and the rear wall and a maximum depth ($D_2$) of the opening formed by the mouth structure; such that $W_1$ is greater than $W_2$ and $D_1$ is greater than $D_2$, and further wherein at least one side wall includes a flat portion that is bounded by curved portions, wherein a curved portion curves outwardly from the shoulder and another curved portion curves inwardly to the bottom, and wherein the flat portion is vertically oriented;

and wherein the side walls each have a radius of curvature from the shoulder to the bottom along the length of the side wall; and b. a lid connected to the tub using the fastening feature, the lid having an open position for allowing user access to the containing volume and a closed position for preventing user access to the containing volume, wherein the lid comprises:

a tub connecting portion including an engaging feature configured to engage the fastening feature of the mouth structure; and a lid closure portion configured for movement relative to the tub connecting portion between the open position and the closed position, wherein the lid closure portion comprises a top and a hood, wherein the hood extends outwardly and downwardly from the top.

2. The container system of claim 1, wherein the tub includes a handle structure formed integrally with the rear wall of the tub.

3. The container system of claim 2, wherein the handle structure includes an inwardly extending portion extending inwardly from the rear wall toward the front wall of the tub and an outwardly extending portion that extends outwardly toward one of the side walls of the tub.

4. The container system of claim 3, wherein the handle structure is a first handle structure, the container system further comprising a second handle structure formed integrally with the rear wall of the tub, including an inwardly extending portion extending inwardly from the rear wall toward the front wall of the tub and an outwardly extending portion that extends outwardly toward another one of the side walls of the tub.

5. The container system of claim 1 further comprising a bead of a perfume-comprising hot melt adhesive applied to at least one of the tub and the lid.

6. The container system of claim 1, wherein the lid closure portion is hingedly connected to the tub connecting portion such that the lid closure portion moves between the open position and the closed position while remaining connected to the tub connecting portion.

7. The container system of claim 6, wherein the lid further comprises a latching system configured to latch the lid closure portion to the tub connecting portion with the lid closure portion in the closed position.

8. The container system of claim 7, wherein the latching system comprises a latch member including an engaging member that projects outwardly from a tub facing surface of the latch member, the engaging member arranged and configured to engage a latch engaging feature of the tub connecting portion.

9. The container system of claim 8, wherein the latch member is operable to move between a latch position and an unlatch position, wherein in the latch position the engaging member being engaged with the latch engaging feature of the tub connecting portion, wherein in the unlatch position the engaging member being out of engagement with the latch engaging feature of the tub connecting portion.

10. The container system of claim 8, wherein the latch member includes an upper portion, a lower portion, side portions and a window located between the upper portion, lower portion and side portions.

11. The container system of claim 1, wherein the tub connecting portion includes an opening extending there through that is aligned with the opening of the mouth structure, the tub connecting portion further comprising a sealing lip that extends into the opening of the tub connecting portion.

12. The container system of claim 11, wherein the lid closure portion includes a top and a sealing rib extending downwardly from the top such that an end of the sealing rib is adjacent a sealing surface of the sealing lip with the lid closure portion in the closed position.

13. The container system of claim 12, wherein the sealing lip extends continuously about the entire periphery of the opening of the tub connecting portion.

14. The container system of claim 13, wherein the sealing rib extends continuously about the entire periphery of the opening of the tub connecting portion with the lid closure portion in the closed position.

15. A container system comprising:

a. a tub comprising:

a front wall comprising a recess;

a rear wall opposite the front wall;

side walls extending between the front wall and the rear wall, wherein the side walls have convex curvature;

a bottom extending between the front wall, rear wall and side walls;

a mouth structure connected to the front, rear, and side walls, the mouth structure including a fastening feature configured for connecting to a lid and having an opening there through that provides access to a containing volume of the tub;

a shoulder extending inwardly from the side walls to the mouth structure;

a plurality of unitized doses of a composition within the containing volume of the tub, a first handle structure formed integrally with the rear wall of the tub, wherein the handle structure includes an inwardly extending portion extending inwardly from the rear wall toward the front wall of the tub and an outwardly extending portion that extends outwardly toward one of the side walls of the tub and a second handle structure formed integrally with the rear wall of the tub, including an inwardly extending portion extending inwardly from the rear wall toward the front wall of the tub and an outwardly extending portion that extends outwardly toward another one of the side walls of the tub, wherein each of the inwardly extending portions includes top and bottom edges that intersect the side walls, and wherein each of the outwardly extending portions has a contour that is curved from the top edge to the bottom edge;

and wherein the side walls each have a radius of curvature from the shoulder to the bottom along the length of the side wall; and b. a lid connected to the tub using the fastening feature, the lid having an open position for allowing user access to the containing volume and a closed position for preventing user access to the containing volume.

16. The container system of claim 15, wherein the lid comprises:

a tub connecting portion including an engaging feature configured to engage the fastening feature of the mouth structure; and a lid closure portion configured for movement relative to the tub connecting portion between the open position and the closed position.

17. The container system of claim 16, wherein:

the tub connecting portion includes an opening extending there through that is aligned with the opening of the mouth structure, the tub connecting portion further comprising a sealing lip that extends into the opening of the tub connecting portion;

the lid closure portion includes a top and a sealing rib extending downwardly from the top such that an end of the sealing rib is adjacent a sealing surface of the sealing lip with the lid closure portion in the closed position; and the sealing lip extends continuously about the entire periphery of the opening of the tub connecting portion with the lid closure portion in the closed position.

18. The container system of claim 15, wherein the tub has: a maximum width ($W_1$) measured between the side walls of the tub; a maximum width ($W_2$) of the opening through the mouth structure; a maximum depth ($D_1$) measured between the front wall and the rear wall and a maximum depth ($D_2$) of the opening formed by the mouth structure; such that $W_1$ is greater than $W_2$ and $D_1$ is greater than $D_2$.

19. A container system comprising:

a. a tub comprising:

a front wall comprising a recess;

a rear wall opposite the front wall;

side walls extending between the front wall and the rear wall, wherein the side walls have convex curvature;

a bottom extending between the front wall, rear wall and side walls;

a mouth structure connected to the front, rear, and side walls, the mouth structure including a fastening feature configured for connecting to a lid and having an opening there through that provides access to a containing volume of the tub; and a shoulder extending inwardly from the side walls to the mouth structure;

a plurality of unitized doses of a composition within the containing volume of the tub, wherein the tub has: a maximum width ($W_1$) measured between the side walls of the tub;

a maximum width ($W_2$) of the opening through the mouth structure; a maximum depth ($D_1$) measured between the front wall and the rear wall and a maximum depth ($D_2$) of the opening formed by the mouth structure; such that $W_1$ is greater than $W_2$ and $D_1$ is greater than $D_2$;

a first handle structure formed integrally with the rear wall of the tub, wherein the handle structure includes an inwardly extending portion extending inwardly from the rear wall toward the front wall of the tub and an outwardly extending portion that extends outwardly toward one of the side walls of the tub;

a second handle structure formed integrally with the rear wall of the tub including an inwardly extending portion extending inwardly from the rear wall toward the front wall of the tub and an outwardly extending portion that extends outwardly toward another one of the side walls of the tub;

wherein each of the inwardly extending portions includes top and bottom edges that intersect the side walls, and wherein each of the outwardly extending portions has a contour that is curved from the top edge to the bottom edge;

and wherein the side walls each have a radius of curvature from the shoulder to the bottom along the length of the side wall; and b. a lid connected to the tub using the fastening feature, the lid having an open position for allowing user access to the containing volume and a closed position for preventing user access to the containing volume.

20. The container system of claim 8, wherein the latch member includes a line of weakness located on an external surface of the latch member.

21. The container system of claim 1, wherein the fastening feature is a single, continuous rib that extends about the periphery of the mouth structure.

22. The container system of claim 1, wherein the tub is formed of a clear material.

23. The container system of claim 4, wherein each of the inwardly extending portions includes top and bottom edges that intersect the side walls, and wherein each of the outwardly extending portions has a contour that is curved from the top edge to the bottom edge.

24. The container system of claim 1, wherein the top comprises a ledge extending upwardly from the top about the periphery of the top.

25. The container system of claim 1, wherein the bottom of the tub has a footprint with a surface area that is less than the surface area of the top of the lid.

26. The container system of claim 1, wherein the front wall, the rear wall, or both are slanted at an angle of five degrees or less relative to the vertical.

27. The container system of claim 1, wherein the tub is formed of an opaque material.

28. The container system of claim 1, wherein the radius of curvature of both side walls is about the same along the lengths of the side walls.

29. The container system of claim 4, wherein the radius of curvature of both side walls is about the same along the lengths of the side walls, and wherein the tub is formed of an opaque material.

* * * * *